US012698590B2

(12) United States Patent
Pierog-Sheehan et al.

(10) Patent No.: US 12,698,590 B2
(45) Date of Patent: Aug. 4, 2026

(54) PROCESSES FOR FRACTIONATION OF BIOMASS

(71) Applicant: THE BOARD OF TRUSTEES OF THE UNIVERSITY OF ALABAMA, Tuscaloosa, AL (US)

(72) Inventors: James Dennis Pierog-Sheehan, Tuscaloosa, AL (US); Jason E. Bara, Tuscaloosa, AL (US)

(73) Assignee: THE BOARD OF TRUSTEES OF THE UNIVERSITY OF ALABAMA, Tuscaloosa, AL (US)

( * ) Notice: Subject to any disclaimer, the term of this patent is extended or adjusted under 35 U.S.C. 154(b) by 116 days.

(21) Appl. No.: 18/758,566

(22) Filed: Jun. 28, 2024

(65) Prior Publication Data

US 2025/0075425 A1 Mar. 6, 2025

Related U.S. Application Data

(60) Provisional application No. 63/535,172, filed on Aug. 29, 2023.

(51) Int. Cl.

| | |
|---|---|
| ***D21C 11/00*** | (2006.01) |
| ***D21C 3/00*** | (2006.01) |
| ***D21C 3/20*** | (2006.01) |
| ***D21C 3/22*** | (2006.01) |

(52) U.S. Cl.

CPC ..... *D21C 11/0007* (2013.01); *D21C 3/003* (2013.01); *D21C 3/006* (2013.01); *D21C 3/20* (2013.01); *D21C 3/222* (2013.01)

(58) Field of Classification Search

CPC ..... D21C 3/003; D21C 3/006; D21C 3/20; Y02W 30/62; Y02W 30/64; Y02W 30/66

See application file for complete search history.

(56) References Cited

FOREIGN PATENT DOCUMENTS

WO WO-2013050717 A1 * 4/2013 ..... A61Q 1/00

OTHER PUBLICATIONS

English Translation WO201305017A1, 2013. (Year: 2013).*

Abranches, et al., "Phenolic Hydrogen Bond Donors in the Formation of Non-Ionic Deep Eutectic Solvents: The Quest for Type V DES", Chemical Communications, vol. 55, Issue 69, pp. 10253-10256, 2019.

Agwu, et al., "Polar Aprotic Solvent Properties Influence Pulp Characteristics and Delignification Kinetics of CO2/Organic Base Organosolv Pretreatments of Lignocellulosic Biomass", Chemical Engineering Science, vol. 288, Article 119808, 26 pages, Apr. 15, 2024.

Zhang, et al., "Organosolv Pretreatment of Plant Biomass for Enhanced Enzymatic Saccharification", Green Chemistry, vol. 18, pp. 360-381, 2016.

Aponte, et al., "Use of BioSource Molecules as Liquid Organic Hydrogen Carriers (LOHC) and for Circular Storage", Reactions, vol. 5, Issue 1, pp. 195-212, Feb. 7, 2024.

(Continued)

*Primary Examiner* — Anthony Calandra

(74) *Attorney, Agent, or Firm* — Meunier Carlin & Curfman LLC

(57) ABSTRACT

Disclosed herein are systems and methods delignifying and depolymerizing lignocellulosic biomass into an aromatic species-rich fraction and a carbohydrate-rich fraction. The resultant fractions can be used as raw materials to produce value-added goods from biogenic carbon.

15 Claims, 18 Drawing Sheets

(56) References Cited

OTHER PUBLICATIONS

Arato, et al., "The Lignol Approach to Biorefining of Woody Biomass to Produce Ethanol and Chemicals", Applied Biochemistry and Biotechnology, vol. 121-124, pp. 871-882, Mar. 2005.
Azadi, et al., "Liquid Fuels, Hydrogen and Chemicals from Lignin: A Critical Review", Renewable and Sustainable Energy Reviews, vol. 21, pp. 506-523, May 2013.
Beaucamp, et al., "Lignin for Energy Applications—State of the Art, Life Cycle, Technoeconomic Analysis and Future Trends", Green Chemistry, vol. 24, Issue 21, pp. 8193-8226, Oct. 12, 2022.
Beluhan et al., "The Production of Bioethanol from Lignocellulosic Biomass: Pretreatment Methods, Fermentation, and Downstream Processing", Energies, vol. 16, Issue 19, Article 7003, 38 pages, Oct. 9, 2023.
Brosse, et al., "Organosolv Processes", Advances in Biochemistry and Biotechnology, vol. 166, pp. 153-176, Mar. 10, 2017.
Canter, et al., "Carbon Dynamics for Biofuels Produced from Woody Feedstocks", Energy Systems Division, ANL/ESD-18/10, Argonne National Laboratory, 72 pages, May 2018.
Chen, et al., "Lignin First: Confirming the Role of the Metal Catalyst in Reductive Fractionation", JACS Au, vol. 1, Issue 6, pp. 729-733, Apr. 22, 2021.
Chen, et al., "Steric Effect Tuned Ion Solvation Enabling Stable Cycling of High-Voltage Lithium Metal Battery", Journal of the American Chemical Society, vol. 143, Issue 44, pp. 18703-18713, Oct. 28, 2021.
Cheng, et al., "Highly Efficient Liquefaction of Woody Biomass in Hot-Compressed Alcohol-Water Co-Solvents", Energy and Fuels, vol. 24, Issue 9, pp. 4659-4667, Feb. 15, 2010.
Cheng, et al., "Poplar Lignin Structural Changes during Extraction in γ-Valerolactone (GVL)", Green Chemistry, vol. 25, Issue 1, pp. 336-347, 2023.
Chu, et al., "Hydrogen Storage by Liquid Organic Hydrogen Carriers: Catalyst, Renewable Carrier, and Technology—A Review", Carbon Resources Conversion, vol. 6, Issue 4, pp. 334-351, Dec. 2023.
Del Rio, et al., "The Effect of Varying Organosolv Pretreatment Chemicals on the Physicochemical Properties and Cellulolytic Hydrolysis of Mountain Pine Beetle-Killed Lodgepole Pine", Applied Biochemistry and Biotechnology, vol. 161, 21 pages, Oct. 8, 2009.
Deng, et al., "Catalytic Conversion of Lignocellulosic Biomass into Chemicals and Fuels", Green Energy & Environment, vol. 8, Issue 1, pp. 10-114, Feb. 2023.
Diaz-Alvarez, et al., "A Promising Green Solvent and Reducing Agent for Metal-Catalyzed Transfer Hydrogenation Reactions and Nanoparticles Formation", Applied Sciences, vol. 3, Issue 1, pp. 55-69, Jan. 23, 2013.
Du, et al., "Catalytic Hydrogenolysis Lignin to Obtain Phenols: A Review of Selective Cleavage of Ether Bonds", BioResources, vol. 18, Issue 2, pp. 4231-4261, 2023.
Ebikade, et al., "Reductive Catalytic Fractionation of Agricultural Residue and Energy Crop Lignin and Application of Lignin Oil in Antimicrobials", Green Chemistry, vol. 22, Issue 21, pp. 7435-7447, Oct. 2, 2020.
Energy Information Administration, "EIA Projects Nearly 50% Increase in World Energy Usage by 2050, Led by Growth in Asia", Available online at URL—[https://www.eia.gov/todayinenergy/detail.php?id=41433], 3 pages, Sep. 24, 2019.
Erismann, et al., "Organosolv Pulping-VII: Delignification Selectivity of Formic Acid Pulping of Eucalyptus Grandis", Bioresource Technology, vol. 47, Issue 3, pp. 247-256, 1994.
Facas, et al., "Interdependence of Solvent and Catalyst Selection on Low Pressure Hydrogen-Free Reductive Catalytic Fractionation", ACS Sustainable Chemistry & Engineering, vol. 11, Issue 12, pp. 4517-4522, Mar. 13, 2023.
Fang, et al., "Modified 1,4-Butanediol Organosolv Pretreatment on Hardwood and Softwood for Efficient Coproduction of Fermentable Sugars and Lignin Antioxidants", Bioresource Technology, vol. 376, Article 128854, May 2023.
Ferlin, et al., "Catalytic Biomass Upgrading Exploiting Liquid Organic Hydrogen Carriers (LOHCs)", ACS Sustainable Chemistry & Engineering, vol. 9, Issue 29, pp. 9604-9624, Jul. 14, 2021.
Flowers, et al., "1,2,3-Trimethoxypropane: A Glycerol-Derived Physical Solvent for CO2 Absorption", ACS Sustainable Chemistry and Engineering, vol. 5, Issue 1, pp. 911-921, Oct. 24, 2016.
Fraga, et al., "Hydrocarbon Hydrogen Carriers for Catalytic Transfer Hydrogenation of Guaiacol", International Journal of Hydrogen Energy, vol. 45, Issue 51, pp. 27381-27391, Oct. 16, 2020.
Gan, et al., "Lignin to Value-Added Chemicals and Advanced Materials: Extraction, Degradation, and Functionalization", Green Chemistry, vol. 24, Issue 20, pp. 7705-7750, 2022.
Glasser, Wolfgang G., "About Making Lignin Great Again—Some Lessons from the Past", Frontiers in Chemistry, vol. 7, Article 565, 17 pages, Aug. 29, 2019.
Godwin, et al., "Catalytic Transfer Hydrogenolysis of Switchgrass Lignin with Ethanol Using Spinel-Type Mixed-Metal Oxide Catalysts Affords Control of the Oxidation State of Isolated Aromatic Products", ACS Sustainable Chemistry & Engineering, vol. 12, Issue 7, 40 pages, Feb. 2, 2024.
Goh, et al., "Evaluation and Optimization of Organosolv Pretreatment Using Combined Severity Factors and Response Surface Methodology", Biomass and Bioenergy, vol. 35, Issue 9, pp. 4025-4033, Oct. 2011.
Gschwend, et al., "Rapid Pretreatment of: Miscanthus Using the Low-Cost Ionic Liquid Triethylammonium Hydrogen Sulfate at Elevated Temperatures", Green Chemistry, vol. 20, Issue 15, pp. 3486-3498, Jun. 29, 2018.
Gurrala, et al., "Catalytic Hydrogenolysis of Lignin to Phenols: Effect of Operating Conditions on Product Distribution", Biomass, Biofuels, Biochemicals: Lignin Biorefinery, Chapter 5, pp. 83-107, 2021.
Halkos, et al., "Reviewing Usage, Potentials, and Limitations of Renewable Energy Sources", Energies, vol. 13, Issue 11, Article 2906, 19 pages, Jun. 5, 2020.
Hansen, Charles M., "Methods of Characterization—Surfaces", Hansen Solubility Parameters: A Users Handbook. Hansen Solubility Parameters: A Users Handbook, Second Edition, pp. 113-123, 2007.
Hempfling, et al., "Chemical Characterization of the Organic Matter in Forest Soils by Curie Point Pyrolysis—GC/MS and Pyrolysis-Field Ionization Mass Spectrometry", Organic Geochemistry, vol. 15, Issue 2, pp. 131-145, 1990.
Hou, et al., "Upcycling and Catalytic Degradation of Plastic Wastes", Cell Reports Physical Science, vol. 2, Issue 8, Article 100514, 30 pages, Aug. 18, 2021.
Hu, et al., "Catalytic Transfer Hydrogenolysis of Native Lignin to Monomeric Phenols over a Ni—Pd Bimetallic Catalyst", Energy and Fuels, vol. 34, Issue 8, pp. 9754-9762, Jul. 28, 2020.
Huang, et al., "Investigation of Glycerol-Derived Binary and Ternary Systems in CO2 Capture Process", Fuel, vol. 210, pp. 836-843, Dec. 15, 2017.
Isikgor, et al., "Lignocellulosic Biomass: A Sustainable Platform for the Production of Bio-Based Chemicals and Polymers", Polymer Chemistry, vol. 6, Issue 25, pp. 4497-4559, May 5, 2015.
Jang, et al., "Feedstock-Agnostic Reductive Catalytic Fractionation in Alcohol and Alcohol-Water Mixtures", Green Chemistry, vol. 25, Issue 9, pp. 3660-3670, Apr. 12, 2023.
Jang, et al., "Multi-Pass Flow-Through Reductive Catalytic Fractionation", Joule, vol. 6, Issue 8, pp. 1859-1875, Aug. 17, 2022.
Joy, et al., "Modified Organosolv Pretreatment for Improved Cellulosic Ethanol Production from Sorghum Biomass", Industrial Crops and Products, vol. 177, Article 114409, Mar. 2022.
Kargarzadeh, et al., "Effects of Hydrolysis Conditions on the Morphology, Crystallinity, and Thermal Stability of Cellulose Nanocrystals Extracted from Kenaf Bast Fibers", Cellulose, vol. 19, Issue 3, pp. 855-866, Mar. 6, 2012.
Karlsson, et al., "Lignin Structure and Reactivity in the Organosolv Process Studied by NMR Spectroscopy, Mass Spectrometry, and Density Functional Theory", Biomacromolecules, vol. 24, Issue 5, pp. 2314-2326, Apr. 20, 2023.

(56) References Cited

OTHER PUBLICATIONS

Kenny, et al., "Catalyst Choice Impacts Aromatic Monomer Yields and Selectivity in Hydrogen-Free Reductive Catalytic Fractionation", Reaction Chemistry and Engineering, vol. 7, Issue 12, pp. 2527-2533, Aug. 16, 2022.
Khallouk, et al., "Effective Catalytic Delignification and Fractionation of Lignocellulosic Biomass in Water over Zn3V2O8 Mixed Oxide", ACS Omega, vol. 5, Issue 1, pp. 304-316, Dec. 31, 2019.
Kumar, et al., "Lignin Depolymerization to Guaiacol and Vanillin Derivatives via Catalytic Transfer Hydrogenolysis Using Pd-Lewis Metal Oxide Supported on Activated Carbon Catalysts", Molecular Catalysis, vol. 549, Article 113474, Oct. 2023.
Kumar, et al., "Selective Production of Guaiacol from Lignin via Catalytic Transfer Hydrogenolysis Using Ru—Cu/Zirconia", Molecular Catalysis, vol. 530, Article 112532, Sep. 2022.
Leal-Duaso, et al., "Glycerol-Derived Solvents: Synthesis and Properties of Symmetric Glyceryl Diethers", ACS Sustainable Chemistry & Engineering, vol. 7, Issue 15, 33 pages, Jul. 3, 2019.
Lee, et al., "Efficiencies of Acid Catalysts in the Hydrolysis of Lignocellulosic Biomass over a Range of Combined Severity Factors", Bioresource Technology, vol. 102, Issue 10, pp. 5884-5890, May 2011.
Li, et al., "Cost-Effective Production of Organosolv Lignin from Woody Biomass Using Ethanol-Water Mixed Solvent at Mild Conditions", The Journal of Supercritical Fluids, vol. 158, Article 104745, Apr. 1, 2020.
Li, et al., "Hydrogen-Free Production of 4-Alkylphenols from Lignin via Self-Reforming-Driven Depolymerization and Hydrogenolysis", ACS Catalysis, vol. 10, Issue 24, pp. 15197-15206, Dec. 9, 2020.
Liu, et al., "Catalytic Etherification of Glycerol with Short Chain Alkyl Alcohols in the Presence of Lewis Acids", Green Chemistry, vol. 15, Issue 4, pp. 901-909, Jan. 28, 2013.
Liu, et al., "Chemodivergent Hydrogenolysis of Eucalyptus Lignin with Ni@ZIF-8 Catalyst", Green Chemistry, vol. 21, No. 6, 2019, pp. 1498-1504, Feb. 15, 2019.
Liu, et al., "Rational Highly Dispersed Ruthenium for Reductive Catalytic Fractionation of Lignocellulose", Nature Communications, vol. 13, Issue 1, Article 4716, 11 pages, Aug. 11, 2022.
Liu, et al., "Recent Advances in the Catalytic Depolymerization of Lignin towards Phenolic Chemicals□: A Review", ChemSusChem, vol. 13, Issue 17, pp. 4296-4317, Jul. 14, 2020.
Lomwongsopon, et al., "Critical Review on the Progress of Plastic Bioupcycling Technology as a Potential Solution for Sustainable Plastic Waste Management", Polymers, vol. 14, Issue 22, Article 4996, 30 pages, Nov. 18, 2022.
Lopez, et al., "From Fossil to Green Chemicals: Sustainable Pathways and New Carbon Feedstocks for the Global Chemical Industry", Energy & Environmental Science, vol. 16, Issue 7, pp. 2879-2909, May 18, 2023.
Lu, et al., "Selective Catalytic Transfer Hydrogenation of Lignin to Alkyl Guaiacols Over NiMo/Al—MCM-41", ChemSusChem, vol. 15, Issue 7, Article e202200099, 15 pages, Feb. 22, 2022.
Lu, et al., "Selective Conversion of Lignocellulosic Biomass into Furan Compounds Using Bimetal-Modified Bio-Based Activated Carbon: Analytical Py—GC×GC/MS", Journal of the Energy Institute, vol. 93, Issue 6, pp. 2371-2380, Dec. 2020.
Margellou, et al., "Catalytic Transfer Hydrogenolysis Reactions for Lignin Valorization to Fuels and Chemicals", Catalysts, vol. 9, Issue 1, Article 43, 31 pages, Jan. 4, 2019.
Mei, et al., "Catalytic Self-Transfer Hydrogenolysis of Lignin over Ni/C Catalysts", Green Chemistry, vol. 26, Issue 8, pp. 4544-4551, Apr. 22, 2024.
Meng, et al., "A Biomass Pretreatment Using Cellulose-Derived Solvent Cyrene", Green Chemistry, vol. 22, Issue 9, pp. 2862-2872, Apr. 7, 2020.
Meng, et al., "Applications of Biomass-Derived Solvents in Biomass Pretreatment-Strategies, Challenges, and Prospects", Bioresource Technology, vol. 368, Article 128280, 51 pages, Jan. 2023.
Meng, et al., "Chemical Transformations of Poplar Lignin during Cosolvent Enhanced Lignocellulosic Fractionation Process", ACS Sustainable Chemistry & Engineering, vol. 6, Issue 7, pp. 8711-8718, May 24, 2018.
Mohan, et al., "Prediction of Solubility Parameters of Lignin and Ionic Liquids Using Multi-Resolution Simulation Approaches", Green Chemistry, vol. 24, Issue 3, pp. 1165-1176, 2022.
Mujtaba, et al., "Lignocellulosic Biomass from Agricultural Waste to the Circular Economy: A Review with Focus on Biofuels, Biocomposites and Bioplastics", Journal of Cleaner Production, vol. 402, Article 136815, 23 pages, May 20, 2023.
Muley, et al., "Rapid Microwave-Assisted Biomass Delignification and Lignin Depolymerization in Deep Eutectic Solvents", Energy Conversion and Management, vol. 196, pp. 1080-1088, Sep. 15, 2019.
Ni, et al., "Catalytic Hydrogen Storage in Liquid Hydrogen Carriers", EES Catalysis, vol. 1, Issue 4, pp. 459-494, May 22, 2023.
Nitsos, et al., "Isolation and Characterization of Organosolv and Alkaline Lignins from Hardwood and Softwood Biomass", ACS Sustainable Chemistry & Engineering, vol. 4, Issue 10, pp. 5181-5193, Sep. 12, 2016.
Novo, et al., "Hansen Solubility Parameters: A Tool for Solvent Selection for Organosolv Delignification", Industrial & Engineering Chemistry Research, vol. 58, Issue 31, pp. 14520-14527, Jul. 1, 2019.
O'Dea, et al., "Ambient-Pressure Lignin Valorization to High-Performance Polymers by Intensified Reductive Catalytic Deconstruction", Science Advances, vol. 8, Issue 3, Article 7523, 10 pages, Jan. 19, 2022.
Okolie, Jude A., "Insights on Production Mechanism and Industrial Applications of Renewable Propylene Glycol", Iscience, vol. 25, Issue 9, Article 104903, 19 pages, Sep. 16, 2022.
Oliva, et al., "Effect of Methanol-Organosolv Pretreatment on Anaerobic Digestion of Lignocellulosic Materials", Renewable Energy, vol. 169, pp. 1000-1012, May 2021.
Oswalt, et al., "Forest Resources of the United States, 2017 A Technical Document Supporting the Forest Service 2020 RPA Assessment", General Technical Reports, Department of Agriculture, 237 pages, Mar. 2019.
Ouyang, et al., "Catalytic Conversion of Lignin in Woody Biomass into Phenolic Monomers in Methanol/Water Mixtures without External Hydrogen", ACS Sustainable Chemistry & Engineering, vol. 7, Issue 16, pp. 13764-13773, Jul. 23, 2019.
Ovejero-Perez, et al., "Organosolv and Ionosolv Processes for Autohydrolyzed Poplar Fractionation□: Lignin Recovery and Characterization", International Journal of Biological Macromolecules, vol. 197, pp. 131-140, Feb. 1, 2022.
Park, et al., "Organosolv Pretreatment with Various Catalysts for Enhancing Enzymatic Hydrolysis of Pitch Pine (*Pinus rigida*)", Bioresource Technology, vol. 101, Issue 18, pp. 7046-7053, Sep. 2010.
Petridis, et al., "Molecular-Level Driving Forces in Lignocellulosic Biomass Deconstruction for Bioenergy", Nature Reviews Chemistry, vol. 2, Issue 11, 19 pages, Oct. 18, 2018.
Prat, et al., "CHEM21 Selection Guide of Classical- and Less Classical-Solvents", Green Chemistry, vol. 18, Issue 1, pp. 288-296, Aug. 13, 2015.
Pye, et al., "The Alcell Process A Proven Alternative to Kraft Pulping", Tappi Journal, vol. 74, Issue 3, pp. 113-117, Mar. 1991.
Qian, et al., "Properties of Symmetric 1,3-Diethers Based on Glycerol Skeletons for CO2 Absorption", Fluid Phase Equilibria, vol. 521, Article 112718, Oct. 15, 2020.
Qian, et al., "Synthesis and Properties of 1,2,3-Triethoxypropane: A Glycerol-Derived Green Solvent Candidate", Industrial & Engineering Chemistry Research, vol. 59, Issue 45, pp. 20190-20200, Oct. 28, 2020.
Rabelo, et al., "Organosolv Pretreatment for Biorefineries: Current Status, Perspectives, and Challenges", Bioresource Technology, vol. 369, Feb. 2023.
Ragauskas, et al., "Lignin Valorization: Improving Lignin Processing in the Biorefinery", Science, vol. 344, No. 6185, pp. 1246843-1-1246843-10, May 16, 2014.

(56) References Cited

OTHER PUBLICATIONS

Regmi, et al., "Catalytic Transfer Hydrogenolysis of Organosolv Lignin Using B-Containing FeNi Alloyed Catalysts", Catalysis Today, vol. 302, 16 pages, Mar. 15, 2018.
Ren, et al., "Highly Selective Reductive Catalytic Fractionation at Atmospheric Pressure without Hydrogen", Green Chemistry, vol. 23, Issue 4, pp. 1648-1657, Feb. 21, 2021.
Rencoret, et al., "Lignin Composition and Structure in Young versus Adult Eucalyptus Globulus Plants", Plant physiology, vol. 155, Issue 2, pp. 667-682, Feb. 2011.
Renders, et al., "Influence of Acidic (H3PO4) and Alkaline (NaOH) Additives on the Catalytic Reductive Fractionation of Lignocellulose", ACS Catalysis, vol. 6, Issue 3, pp. 2055-2066, Feb. 10, 2016.
Rinken, et al., "Lignin Stabilization and Carbohydrate Nature in H-Transfer Reductive Catalytic Fractionation: The Role of Solvent Fractionation of Lignin Oil in Structural Profiling", ChemSusChem, vol. 16, Issue 3, Article e202201875, 13 pages, 2023.
Romani, et al., "Valorization of Eucalyptus Nitens Bark by Organosolv Pretreatment for the Production of Advanced Biofuels", Industrial Crops and Products, vol. 132, pp. 327-335, Jun. 2019.
Roy, et al., "Recent Advances in Lignin Depolymerization Techniques: A Comparative Overview of Traditional and Greener Approaches", Biomass, vol. 2, Issue 3, pp. 130-154, Jul. 1, 2022.
Salapa, et al., "Simulation and Optimization of Barley Straw Organosolv Pretreatment", Industrial Crops and Products, vol. 113, pp. 80-88, Mar. 2018.
Schutyser, et al., "Chemicals from Lignin: An Interplay of Lignocellulose Fractionation, Depolymerisation, and Upgrading", Chemical Society Reviews, vol. 47, Issue 3, pp. 852-908, 2018.
Schutyser, et al., "Influence of Bio-Based Solvents on the Catalytic Reductive Fractionation of Birch Wood", Green Chemistry, vol. 17, Issue 11, pp. 5035-5045, Sep. 3, 2015.
Sette, et al., "Elucidation of Lignin Structure by Quantitative 2D NMR", Chemistry—A European Journal, vol. 17, Issue 34, pp. 9529-9535, Jun. 30, 2011.
Sheehan, et al., "Lignin-Based Water-Soluble Polymers Exhibiting Biodegradability and Activity as Flocculating Agents", ACS Sustainable Chemistry & Engineering, vol. 10, Issue 34, pp. 11117-11129, Aug. 16, 2022.
Sheldon, Roger A., "Metrics of Green Chemistry and Sustainability: Past, Present, and Future", ACS Sustainable Chemistry & Engineering, vol. 6, Issue 1, 17 pages, Nov. 8, 2017.
Shen, et al., "Catalytic Self-Transfer Hydrogenolysis of Lignin with Endogenous Hydrogen: Road to the Carbon-Neutral Future", Chemical Society Reviews, vol. 51, Issue 5, pp. 1608-1628, 2022.
Singh, et al., "Editorial: Emerging Feedstocks & Clean Technologies for Lignocellulosic Biofuel", Frontiers in Energy Research, vol. 10, Article 917081, 2 pages, Jul. 26, 2022.
Sirvio, et al., "Supramolecular Interaction-Driven Delignification of Lignocellulose", Green Chemistry, vol. 26, Issue 1, pp. 287-294, 2024.
Sluiter et al., "Determination of Ash in Biomass: Laboratory Analytical Procedure (LAP)", Office of Energy Efficiency & Renewable Energy, Technical Report NREL/TP-510-42622, 8 pages, Jan. 2008.
Sluiter, et al., "Determination of Extractives in Biomass: Laboratory Analytical Procedure (LAP)", Office of Energy Efficiency & Renewable Energy, Technical Report, NREL/TP-510-42619, 11 pages, Jan. 2008.
Sluiter, et al., "Determination of Structural Carbohydrates and Lignin in Biomass: Laboratory Analytical Procedure (LAP)", Office of Energy Efficiency & Renewable Energy, Technical Report, NREL/TP-510-42618, 16 pages, Jan. 2008.
Soares, et al., "Glycerol Ethers as Hydrotropes and Their Use to Enhance the Solubility of Phenolic Acids in Water", ACS Sustainable Chemistry & Engineering, vol. 8, Issue 14, 24 pages, Mar. 23, 2020.
Soares, et al., "Hydrotropy and Cosolvency in Lignin Solubilization with Deep Eutectic Solvents", ACS Sustainable Chemistry & Engineering, vol. 7, Issue 14, pp. 12485-12493, Jun. 16, 2019.
Song, et al., "Lignin Depolymerization (LDP) in Alcohol over Nickel-Based Catalysts via a Fragmentation-Hydrogenolysis Process", Energy & Environmental Science, vol. 6, Issue 3, pp. 994-1007, 2013.
Soyemi, et al., "Calculated Physicochemical Properties of Glycerol-Derived Solvents to Drive Plastic Waste Recycling", Industrial & Engineering Chemistry Research, vol. 62, Issue 15, 55 pages, Mar. 22, 2023.
Sun, et al., "Enhanced Enzymatic Hydrolysis of Wheat Straw by Aqueous Glycerol Pretreatment", Bioresource Technology, vol. 99, Issue 14, pp. 6156-6161, Sep. 2008.
Sun, et al., "Glycerol Organosolv Pretreatment Can Unlock Lignocellulosic Biomass for Production of Fermentable Sugars: Present Situation and Challenges", Bioresource Technology, vol. 344, Part B, Article 126264, Jan. 2022.
Sun, et al., "Organosolv Pretreatment by Crude Glycerol from Oleochemicals Industry for Enzymatic Hydrolysis of Wheat Straw", Bioresource Technology, vol. 99, Issue 13, pp. 5474-5479, Sep. 2008.
Sun, et al., "The Impact of Glycerol Organosolv Pretreatment on the Chemistry and Enzymatic Hydrolyzability of Wheat Straw", Bioresource Technology, vol. 187, pp. 354-361, Jul. 2015.
Takada, et al., "Characterization of Lignin-Derived Products from Japanese Cedar as Treated by Semi-Flow Hot-Compressed Water", Journal of Wood Science, vol. 61, Issue 3, pp. 299-307, Feb. 13, 2015.
Tan, et al., "Comparison Study of Organosolv Pretreatment on Hybrid Pennisetum for Enzymatic Saccharification and Lignin Isolation", Fuel, vol. 249, pp. 334-340, Aug. 1, 2019.
Taran, et al., "Reductive Catalytic Fractionation of Spruce Wood over Ru/C Bifunctional Catalyst in the Medium of Ethanol and Molecular Hydrogen", Catalysts, vol. 12, Issue 11, Article 1384, 22 pages, Nov. 8, 2022.
Tarmadi, et al., "NMR Studies on Lignocellulose Deconstructions in the Digestive System of the Lower Termite Coptotermes Formosanus Shiraki", Scientific Reports, vol. 8, Issue 1, Article 1290, 9 pages, Jan. 22, 2018.
Teramoto, et al., "Cost Reduction and Feedstock Diversity for Sulfuric Acid-Free Ethanol Cooking of Lignocellulosic Biomass as a Pretreatment to Enzymatic Saccharification", Bioresource Technology, vol. 100, Issue 20, 31 pages, Oct. 2009.
Tofani, et al., "Organosolv Biorefinery: Resource-Based Process Optimisation, Pilot Technology Scale-up and Economics", Green Chemistry, vol. 26, Issue 1, pp. 186-201, Nov. 21, 2023.
Traore, et al., "Differentiation Between Pine Woods According to Species and Growing Location Using FTIR-ATR", Wood Science and Technology, vol. 52, Issue 2, pp. 487-504, Nov. 4, 2017.
Trilokesh, et al., "Isolation and Characterization of Cellulose Nanocrystals from Jackfruit Peel", Scientific Reports, vol. 9, Article 16709, 8 pages, Nov. 13, 2019.
US Department of Energy, "BETO: Billion-Ton 2023", Department of Energy, An Assessment of U.S. Renewable Carbon Resources, Available on—[https://www.energy.gov/eere/bioenergy/2023-billion-ton-report-assessment-us-renewable-carbon-resources], 313 pages, Mar. 2024.
Vaidya, et al., "A Review on Organosolv Pretreatment of Softwood with a Focus on Enzymatic Hydrolysis of Cellulose", Biomass Conversion and Biorefinery, vol. 12, Issue 11, pp. 5427-5442, Feb. 8, 2022.
Valentini, et al., "Liquid Organic Hydrogen Carriers (LOHCs) as H-Source for Bio-Derived Fuels and Additives Production", Advanced Energy Materials, vol. 12, Issue 13, Article 2103362, 29 pages, Mar. 2, 2022.
Van Aelst, et al., "Reductive Catalytic Fractionation of Pine Wood: Elucidating and Quantifying the Molecular Structures in the Lignin Oil", Chemical Science, vol. 11, Issue 42, pp. 11498-11508, Sep. 26, 2020.
Vasile, et al., "Lignins as Promising Renewable Biopolymers and Bioactive Compounds for High-Performance Materials", Polymers, vol. 15, Issue 15, Article 3177, 52 pages, Jul. 26, 2023.
Verziu, et al., "Hydrogenolysis of Lignin over Ru-Based Catalysts: The Role of the Ruthenium in a Lignin Fragmentation Process", Molecular Catalysis, vol. 450, pp. 65-76, May 2018.

(56) References Cited

OTHER PUBLICATIONS

Vuillemin, et al., "Revisiting Organosolv Strategies for Sustainable Extraction of Valuable Lignin: The CoffeeCat Process", RSC Sustainability, vol. 1, Issue 4, pp. 853-865, May 10, 2023.
Wada, et al., "Thermally Induced Crystal Transformation from Cellulose Iα to Iβ", Polymer Journal, vol. 35, No. 2, pp. 155-159, Feb. 1, 2003.
Xiang, et al., "A Comparison of Cellulose Nanofibrils Produced from Cladophora Glomerata Algae and Bleached Eucalyptus Pulp", Cellulose, vol. 23, Issue 1, pp. 493-503, Dec. 22, 2015.
Xu, et al., "Comparison of Organosolv Pretreatment of Masson Pine with Different Solvents in Promoting Delignification and Enzymatic Hydrolysis Efficiency", Fuel, vol. 338, Article 127361, Apr. 15, 2023.
Xu, et al., "Recent Catalytic Routes for the Preparation and the Upgrading of Biomass Derived Furfural and 5-Hydroxymethylfurfural", Chemical Society Reviews, vol. 49, Issue 13, pp. 4273-4306, 2020.
Yang, et al., "Ultrasonic and Microwave Assisted Organosolv Pretreatment of Pine Wood for Producing Pyrolytic Sugars and Phenols", Industrial Crops and Products, vol. 157, Article 112921, Dec. 1, 2020.
Yoo, et al., "Effects of Organosolv and Ammonia Pretreatments on Lignin Properties and Its Inhibition for Enzymatic Hydrolysis", Green Chemistry, vol. 19, Issue 8, pp. 2006-2016, Apr. 5, 2017.
Yuan, et al., "Characterization of Lignin Structures and Lignin-Carbohydrate Complex (LCC) Linkages by Quantitative 13C and 2D HSQC NMR Spectroscopy", Journal of Agricultural and Food Chemistry, vol. 59, Issue 19, pp. 10604-10614, Sep. 1, 2011.
Zhan, et al., "Enhancing the Potential Production of Bioethanol with Bamboo by γ-Valerolactone/Water Pretreatment", RSC Advances, vol. 12, Issue 26, pp. 16942-16954, Jun. 7, 2022.
Zhang, et al., "Catalytic Transfer Hydrogenolysis as an Efficient Route in Cleavage of Lignin and Model Compounds", Green Energy & Environment, vol. 3, Issue 4, pp. 328-334, Aug. 23, 2018.
Zhang, et al., "Combined Dehydrogenation of Glycerol with Catalytic Transfer Hydrogenation of H2 Acceptors to Chemicals: Opportunities and Challenges", Frontiers in Chemistry, vol. 10, 15 pages, Aug. 22, 2022.
Zhang, et al., "Laboratory and Pilot Scale Pretreatment of Sugarcane Bagasse by Acidified Aqueous Glycerol Solutions", Bioresource Technology, vol. 138, pp. 14-21, Jun. 2013.

* cited by examiner

PROCESSES FOR FRACTIONATION OF BIOMASS

CROSS-REFERENCE TO RELATED APPLICATION

This application claims the benefit of U.S. Provisional Application 63/535,172, filed Aug. 29, 2023, the contents of which are hereby incorporated in its entirety.

ACKNOWLEDGEMENT OF GOVERNMENT SUPPORT

This invention was made with government support under Grant No. 2029387 awarded by the National Science Foundation. The government has certain rights in the invention.

FIELD OF THE DISCLOSURE

Disclosed herein are systems and methods delignifying and depolymerizing lignocellulosic biomass into an aromatic species-rich fraction and a carbohydrate-rich fraction. The resultant fractions can be used as raw materials to produce value-added goods from biogenic carbon.

BACKGROUND

Biorefining lignocellulosic biomass can enable production of biochemical feedstocks for circular economies. Lignocellulosic biomass is an abundant (181.5 billion tons per year) bio-composite comprised of three main polymers: cellulose (40 to 50 wt %), hemicellulose (20 to 30%), and lignin (15 to 25 wt %). Biomass-to-chemical processes have focused primarily on valorizing carbohydrate fractions (e.g., cellulose, hemicellulose) into value-added products including bio-ethanol, free sugars, and fibers. Lignins are considered primarily a low-value byproduct, for instance, in the chemical pulping industry, lignins are incinerated in the form of "black liquor" to produce low-grade heat and recover pulping reagents. However, lignins are the most abundant, biogenic source for aromatic compounds and their valorization could enhance the economic viability of biorefineries. Presently, only 2% of lignins are recovered from the pulping industry and have elevated content of elemental sulfur (1.5 to 3 wt % for kraft lignins and 4-8 wt % for sulfite lignins), which can inhibit downstream processing into sustainable fuels or chemicals. As such, mild chemical treatments that selectively extract lignins in a sulfur-free form could facilitate the production of aromatic streams suitable for producing fuels and chemicals.

Reductive catalytic fractionation (RCF) is an emergent thermocatalytic process that can support biorefining of lignin. RCF combines solvothermal extraction of lignin with simultaneous catalytic reductive depolymerization to form aromatic species, including, monomers, dimers, and oligomers. In comparison to other biorefining technologies, such as, organosolv, oxidation, pyrolysis, and hydrothermal liquefaction, RCF offers advantages of high carbon atom economy, better selectivity to monomers, and low char formation. RCF of softwood species generally produced monomer yields ranging 10-30 wt % and delignification ranging 40-95 wt %. Common solvents include short chain alcohols like methanol, ethanol, and isopropyl alcohol, and catalysts consist primarily of supported noble metals and Ni nanoparticles. However, a major limitation of RCF is utilization of high-pressure molecular hydrogen (10-50 bar), which necessitates use of capital intensive and specialized high-pressure reactors to mitigate safety risk factors. Liquid-hydrogen carriers can circumvent need for ex situ hydrogen and offers routes for applying "green" hydrogen derived from bio-based chemicals, such as, formic acid and alcohols. As such, hydrogen transfer solvents consisting of liquid-hydrogen carriers can support ex situ $H_2$-free RCF of lignins, however, elevated pressure conditions (>20 bar) still exist owing to the high volatility of predominantly used short-chain (i.e., low boiling point) alcohols. Tractable low-pressure and $H_2$-free RCF processes should apply non-volatile and renewable chemicals as hydrogen transfer solvents.

Non-volatile compounds have garnered research interest as hydrogen transfer solvents to facilitate hydrogenation reactions in biomass conversion processes. Through utilizing non-volatile hydrogen carriers, need for high-pressure storage and transportation infrastructure for molecular hydrogen can be circumvented. Amongst non-volatile, hydrogen transfer solvents, glycerol has gained attention due to its abundance, low-cost, and renewability. Nonetheless, the viscosities of glycerol (1412 mPa s) and glycols (~20 to 50 mPa s) lead to challenges with downstream processability and separations; indeed, processing limitations of glycerol (i.e., very high boiling point and viscosity) contributed to its designation as a "problematic" solvent in the CHEM21 solvent selection guide. Additionally, glycols are derived from petrochemical resources, which limits supporting green chemistry paradigms. As such, new solvent candidates are needed to support sustainable valorization of lignins via $H_2$-free RCF The remains a need for improved systems and methods for converting biomass into useful products. There remains a need for improved systems and methods for converting lignin into chemically simpler blocks. There remains a need for improved systems and methods for depolymerizing lignin in order to produce aromatic and carbohydrate rich fractions.

BRIEF DESCRIPTION OF THE FIGURES

FIG. 1A) 150° C., 60 min, 2 bar He (RT), 12 wt % biomass, 90 vol % GDE, and 20 mN $H_2SO_4$; B) 150° C., 60 min, 2 bar He (RT), 12 wt % biomass, 20 mN $H_2SO_4$. A) Pulp yield is represented with green bars, delignification with gold bars; FIG. 1B) delignification is represented with gold squares and delignification selectivity is represented in blue circles.

DETAILED DESCRIPTION

Figure 1A:
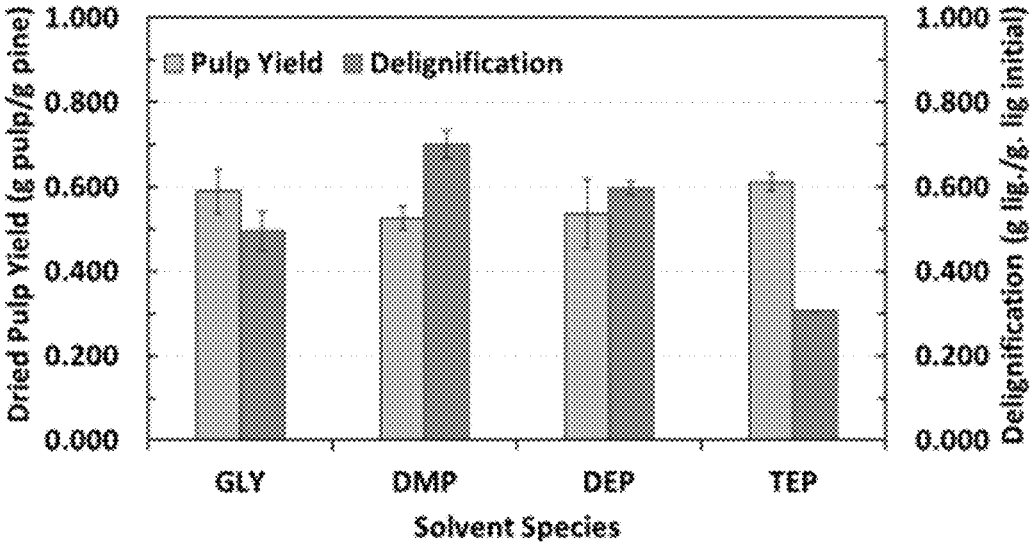
FIGS. 1A and 1B depicts impact of (A) solvent speciation on pulp yield and delignification and (B) DMP solvent volumes on delignification and delignification selectivity. Organosolv pretreatment conditions.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes—from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Compounds disclosed herein may be provided in the form of acceptable salts. Examples of such salts are acid addition salts formed with inorganic acids, for example, hydrochloric, hydrobromic, sulfuric, phosphoric, and nitric acids and the like; salts formed with organic acids such as acetic, oxalic, tartaric, succinic, maleic, fumaric, gluconic, citric, malic, methanesulfonic, p-toluenesulfonic, napthalenesulfonic, and polygalacturonic acids, and the like; salts formed from elemental anions such as chloride, bromide, and iodide; salts formed from metal hydroxides, for example, sodium hydroxide, potassium hydroxide, calcium hydroxide, lithium hydroxide, and magnesium hydroxide; salts formed from metal carbonates, for example, sodium carbonate, potassium carbonate, calcium carbonate, and magnesium carbonate; salts formed from metal bicarbonates, for example, sodium bicarbonate and potassium bicarbonate; salts formed from metal sulfates, for example, sodium sulfate and potassium sulfate; and salts formed from metal nitrates, for example, sodium nitrate and potassium nitrate.

The term "alkyl" refers to a radical of a straight-chain or branched hydrocarbon group having a specified range of carbon atoms (e.g., a "$C_{1-16}$ alkyl" can have from 1 to 16 carbon atoms). An alkyl group can be saturated or unsaturated, i.e., an alkenyl or alkynyl group. Unless specified to the contrary, an "alkyl" group includes both saturated alkyl groups and unsaturated alkyl groups.

When a range of values is listed, it is intended to encompass each value and sub-range within the range. For example, "$C_{1-6}$ alkyl" is intended to encompass $C_1$, $C_2$, $C_3$, $C_4$, $C_5$, $C_6$, $C_{1-6}$, $C_{1-5}$, $C_{1-4}$, $C_{1-3}$, $C_{1-2}$, $C_{2-6}$, $C_{2-5}$, $C_{2-4}$, $C_{2-3}$, $C_{3-6}$, $C_{3-5}$, $C_{3-4}$, $C_{4-6}$, $C_{4-5}$, and $C_{5-6}$ alkyl.

The term "alkoxy" refers to an alkyl group, as defined herein, appended to the parent molecular moiety through an oxygen atom.

The term "heteroalkyl" refers to an alkyl group, which further includes at least one heteroatom (e.g., 1, 2, 3, or 4 heteroatoms) selected from oxygen, nitrogen, or sulfur within (i.e., inserted between adjacent carbon atoms of) and/or placed at one or more terminal position(s) of the parent chain. By way of example, a $C_{1-6}$heteroalkyl) group includes, but is not limited to, the following structures:

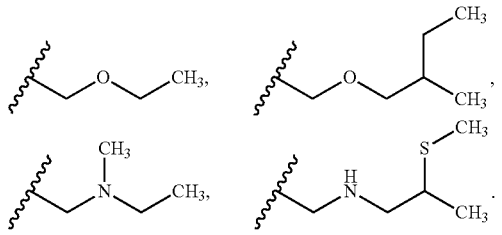

The term "heteroalkyl" preceded by a separate heteroatom refers to a heteroalkyl group bonded through the specified heteroatom. By way of example, a $OC_{1-6}$heteroalkyl group includes, but it not limited to, the following structures:

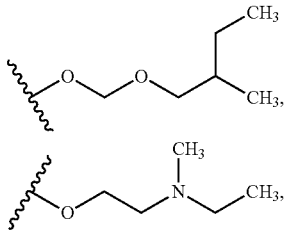

-continued

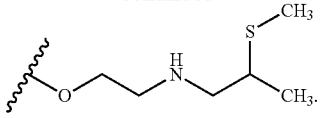

The term "carbocyclyl," "cycloalkyl," or "carbocyclic" refers to a radical of a non-aromatic cyclic hydrocarbon group. A carbocyclyl group can either be monocyclic ("monocyclic carbocyclyl") or polycyclic (e.g., a fused, bridged or spiro ring system such as a bicyclic system ("bicyclic carboocyclyl") or tricyclic system ("tricyclic carbocyclyl")), and can be saturated or can contain one or more carbon-carbon double or triple bonds.

The term "heterocyclyl" refers to a ring system that includes at least one heteroatom in the cycle. A heterocyclyl group can either be monocyclic ("monocyclic heterocyclyl") or polycyclic (e.g., a fused, bridged or spiro ring system such as a bicyclic system ("bicyclic heterocyclyl") or tricyclic system ("tricyclic heterocyclyl")), and can be saturated or can contain one or more carbon-carbon double or triple bonds. Heterocyclyl polycyclic ring systems can include one or more heteroatoms in one or both rings. "Heterocyclyl" also includes ring systems wherein the heterocyclyl ring, as defined above, is fused with one or more carbocyclyl groups wherein the point of attachment is either on the carbocyclyl or heterocyclyl ring, or ring systems wherein the heterocyclyl ring, as defined above, is fused with one or more aryl or heteroaryl groups, wherein the point of attachment is on the heterocyclyl ring, and in such instances, the number of ring members continue to designate the number of ring members in the heterocyclyl ring system. Unless otherwise specified, each instance of heterocyclyl is independently unsubstituted (an "unsubstituted heterocyclyl") or substituted (a "substituted heterocyclyl") with one or more substituents.

The term "aryl" refers to a radical of a monocyclic or polycyclic (e.g., bicyclic or tricyclic) 4n+2 aromatic ring system (e.g., having 6, 10, or 14π electrons shared in a cyclic array) having 6-14 ring carbon atoms and zero heteroatoms provided in the aromatic ring system ("$C_{6-14}$ aryl"). "Aryl" also includes ring systems wherein the aryl ring, as defined above, is fused with one or more carbocyclyl or heterocyclyl groups wherein the radical or point of attachment is on the aryl ring, and in such instances, the number of carbon atoms continue to designate the number of carbon atoms in the aryl ring system. Unless otherwise specified, each instance of an aryl group is independently unsubstituted (an "unsubstituted aryl") or substituted (a "substituted aryl") with one or more substituents.

"Aralkyl" is a subset of "alkyl" and refers to an alkyl group substituted by an aryl group, wherein the point of attachment is on the alkyl moiety.

The term "heteroaryl" refers to a radical of a 5-14 membered monocyclic or polycyclic (e.g., bicyclic, tricyclic) 4n+2 aromatic ring system (e.g., having 6, 10, or 14π electrons shared in a cyclic array) having ring carbon atoms and 1-4 ring heteroatoms provided in the aromatic ring system, wherein each heteroatom is independently selected from nitrogen, oxygen, and sulfur ("5-14 membered heteroaryl"). In heteroaryl groups that contain one or more nitrogen atoms, the point of attachment can be a carbon or nitrogen atom, as valency permits. Heteroaryl polycyclic ring systems can include one or more heteroatoms in one or both rings. "Heteroaryl" includes ring systems wherein the heteroaryl ring, as defined above, is fused with one or more carbocyclyl or heterocyclyl groups wherein the point of attachment is on the heteroaryl ring, and in such instances, the number of ring members continue to designate the number of ring members in the heteroaryl ring system. "Heteroaryl" also includes ring systems wherein the heteroaryl ring, as defined above, is fused with one or more aryl groups wherein the point of attachment is either on the aryl or heteroaryl ring, and in such instances, the number of ring members designates the number of ring members in the fused polycyclic (aryl/heteroaryl) ring system. Polycyclic heteroaryl groups wherein one ring does not contain a heteroatom (e.g., indolyl, quinolinyl, carbazolyl, and the like) the point of attachment can be on either ring, i.e., either the ring bearing a heteroatom (e.g., 2-indolyl) or the ring that does not contain a heteroatom (e.g., 5-indolyl).

As used herein, "lignin compounds" refers to the degradation products of lignin. In certain implementations, lignin compounds include only one aromatic ring, and have a molecular weight of less than 250 Da.

Disclosed herein are methods for processing biomass including the step of heating a mixture comprising biomass and a solvent comprising a compound of Formula (1):

[Formula (1)]

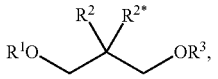

wherein $R^1$ is selected from $C_{1-8}$alkyl, $C_{3-8}$cycloalkyl, $C_{1-2}$alkaryl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl;

$R^3$ is selected from H, $C_{1-8}$alkyl, $C_{3-8}$cycloalkyl, $C_{1-2}$alkaryl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl;

$R^2$ and $R^{2*}$ together form an oxo, or $R^{2*}$ is H and $R^2$ is $OR^{2a}$, wherein $R^{2a}$ is selected from H, $C_{1-8}$alkyl, $C_{3-8}$cycloalkyl, $C_{1-2}$alkaryl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl.

In some implementations, each of $R^1$, $R^{2a}$, and $R^3$ are $C_{1-8}$alkyl, optionally substituted by $C_{1-8}$alkoxy, preferably by $C_{1-3}$alkoxy, In some implementations, $R^{2*}$ is H, and any or all of $R^1$, $R^{2a}$, and $R^3$ are $C_{1-8}$alkyl substituted one or more times by F. In some implementations $R^{2*}$ is H, and any or all of $R^1$, $R^{2a}$, and $R^3$ are perfluoro$C_{1-8}$alkyl, meaning that all hydrogen atoms have been replaced by F, e.g., $CF_3$ (perfluoromethyl), $CF_2CF_3$ (perflouroethyl), $CF(CF_3)_2$ (perfluoroisopropyl), $CF_2CF_2CF_3$ (perfluoro-n-propyl), $CF_2CF_2CF_2CF_3$ (perfluoron-butyl), etc.

In some implementations, $R^{2*}$ is H, and each of $R^1$, $R^{2a}$, and $R^3$ are perfluoro$C_{1-8}$alkyl.

In some implementations, $R^{2a}$ and $R^{2*}$ are both H, and $R^1$ and $R^3$ are independently $C_{1-8}$alkyl.

In some implementations, $R^{2a}$ and $R^{2*}$ are both H, and $R^1$ and $R^3$ are independently perfluoro$C_{1-8}$alkyl.

In some implementations, $R^{2a}$ and $R^{2*}$ are both H, and $R^1$ and $R^3$ are independently selected from methyl, ethyl, isopropyl, 2-methoxyethyl.

In some implementations, $R^{2*}$ is H, and $R^1$, $R^{2a}$, and $R^3$ are independently selected from methyl, ethyl, isopropyl, 2-methoxyethyl.

In some implementations wherein $R^1$ and $R^3$ are each H, $R^{2*}$ is H, and $R^{2a}$ is selected from methyl, ethyl, isopropyl, 2-methoxyethyl.

In some implementations wherein $R^1$, $R^{2a}$, and $R^{2*}$ are each H, $R^3$ is $C_{1-8}$alkyl.

In some implementations wherein $R^1$, $R^{2a}$, and $R^{2*}$ are each H, $R^3$ is perfluoro$C_{1-8}$alkyl.

In some implementations wherein $R^1$, $R^{2a}$, and $R^{2*}$ are each H, $R^3$ is selected from methyl, ethyl, isopropyl, 2-methoxyethyl.

In some implementations wherein $R^1$ and $R^3$ are each H, $R^{2*}$ is H, and $R^{2a}$ is $C_{1-8}$alkyl.

In some implementations wherein $R^1$ and $R^3$ are each H, $R^{2*}$ is H, and $R^{2a}$ is perfluoro$C_{1-8}$alkyl.

In some implementations, $R^{2*}$ and $R^2$ together form an oxo, and $R^1$ and $R^3$ are independently $C_{1-8}$alkyl.

In some implementations, $R^{2*}$ and $R^2$ together form an oxo, and $R^1$ and $R^3$ are independently perfluoro$C_{1-8}$alkyl.

In some implementations, $R^{2*}$ and $R^2$ together form an oxo, and $R^1$ and $R^3$ are independently selected from methyl, ethyl, isopropyl, 2-methoxyethyl.

In certain implementations the compound of Formula (1) is combined with the biomass at a concentration from 0.0001-1 mL/mg biomass, from 0.0001-0.1 mL/mg biomass, from 0.0001-0.01 mL/mg biomass, from 0.0001-0.001 mL/mg biomass, from 0.001-0.1 mL/mg biomass, from 0.001-0.01 mL/mg biomass from 0.01-0.1 mL/mg biomass, or from 0.1-1 mL/mg biomass.

In some implementations, the mixture can include one or more additional solvents, for example water, a $C_{1-4}$alcohol, or a combination thereof. Exemplary $C_{1-4}$alcohols include methanol, ethanol, n-propanol, iso-propanol, n-butanol, iso-butanol, sec-butanol or tert-butanol. When such solvents are present in the mixture, they may be present at a concentration from 1-50 wt. %, from 1-10 wt. %, from 5-15 wt. %, from 10-25 wt. %, from 15-30 wt. %, from 20-50 wt. %, or from 35-50 wt. %, relative to the compound of Formula (1).

The mixture may be heated at a temperature sufficient to degrade lignin into lower molecular weight components. In some implementations, the mixture can be heated to a temperature from 75-250° C., from 75-150° C., from 75-125° C., from 100-250° C., from 100-200° C., from 100-150° C., from 125-175° C., or from 150-200° C.

The mixture may be agitated while heated in order to further accelerate lignin degradation. In implementations, the mixture may be subjected to stirring, shaking, or a reaction vessel containing the mixture may be rotated about one or more axis. In certain implementations the mixture is stirred, for example at a rate from 10-2,000 rpm, 10-1,000 rpm, 10-500 rpm, 10-250 rpm, 10-100 rpm, 10-50 rpm, 50-150 rpm, 100-250 rpm, 100-500 rpm, 250-750 rpm, 500-750 rpm, 500-1,000 rpm, 750-1,000 rpm, 1,000-2,000 rpm, 1,000-1,500 rpm, or 1,500-2,000.

In certain implementations the mixture is agitated under regular atmospheric pressure. In some implementations, the mixture is agitated under enhanced pressure, for example in a sealed reaction vessel.

In some implementations, the mixture may further include one or more catalysts. In some implementations, the catalyst is homogeneous catalyst such as a protic acid, Lewis acid, or combination thereof.

In certain implementations, the catalyst includes a protic acid such as HCl, HBr, HI, $H_2SO_4$, $H_3PO_4$, $HNO_3$, acetic acid, toluenesulfonic acid, trifluoroacetic acid, fluoroacetic acid, propionic acid, or a combination thereof. In some implementations the catalyst includes a Lewis acid such as a metal triflate or metal chloride. Exemplary metal chlorides include iron chloride, copper chloride, cobalt chloride, or a combination thereof. Exemplary metal triflates include iron triflate, gallium triflate, sodium triflate, scandium triflate, yttrium triflate, bismuth triflate, lanthanum triflate. In certain implementations the catalyst is acetic acid.

In some implementations, the homogenous acid is present at a concentration from 0.01-1.0 N, from 0.01-0.5 N, from 0.01-0.25 N, from 0.01-0.1 N, from 0.01-0.05 N, from 0.025-0.075N, from 0.05-0.1 N, from 0.1-0.2 N, or from 0.15-0.2 N.

In some implementations, the catalyst includes a heterogenous catalyst, for example a supported metal. Exemplary supported metals include Pd/C, Pt/C, Ru/C, Ni/C, Ni/alumina, Pd/alumina, Pt/alumina, Ru/alumina, Raney nickel, and Raney cobalt. In some implementations the heterogenous catalyst includes $Fe_2S$ or zeolites.

In some implementations, the heterogeneous catalyst is present in an amount from 1-20 wt. %, from 1-15 wt. %, from 1-10 wt. %, from 1-5 wt. %, from 1-2.5 wt. %, from 2.5-5 wt. %, from 2.5-7.5 wt. %, from 5-10 wt. %, from 5-15 wt. %, from 10-20 wt. %, or from 15-20 wt. %, relative to the mass of the biomass.

After lignin has been degraded according to the above processes, the resulting components may be separated, for instance by filtering. In some implementations, the solvent (containing the lignin compounds) can be separated from the residual solids, optionally with one or more washing sequences. The residual solid is predominantly cellulose. In some implementations the residual solids include cellulose in an amount of at least 90% by mass, at least 95% by mass, at least 97.5% by mass, at least 98% by mass, at least 99% by mass, or at least 99.5% by mass.

The lignin compounds may be separated from the solvent using conventional means. In some instances, the solvent may be distilled away from the lignin compounds, for example under reduced pressure and/or heat. In some implementations, the lignin compounds may be precipitated from the solvent, for example by concentrating the solvent volume, cooling, addition of an anti-solvent and/or seed, or a combination thereof. The resulting solid can include lignin compounds in an amount of at least 90% by mass, at least 95% by mass, at least 97.5% by mass, at least 98% by mass, at least 99% by mass, or at least 99.5% by mass.

In some implementations the process provides furan compounds. In certain implementations the process provides 2-furaldehyde, tetrahydrofuran, 5-hydroxymethylfurfural, furan-2,5-discarboxylic acid, levulinic acid, or a combination thereof.

In certain implementations the biomass is obtained from a vegetative species. In certain implementations the biomass includes woody plants, grasses, leaves, or a combination thereof. In certain implementations the biomass includes wood chips. The wood chips may have an average particle size from 10 to 10,000 μm, from 1,000-10,000 μm, from 10-1,000 μm, from 100-1,000 μm, from 500-1,000 μm, from 100-500 μm, from 250-500 μm, from 500-750 μm, from 250-750 μm, from 100-250 μm, or from 10-100 μm. The biomass may be ground and sorted into appropriate particle sizes using sieves.

In some implementations the biomass may be dehydrated prior to combining with the compound of Formula (1). In some implementations the biomass may include water in an amount less than 20 wt. %, less than 15 wt. %, less than 10 wt. %, less than 7.5 wt. %, less than 5 wt. %, less than 2.5 wt. %, or less than 1 wt. %. In some implementations the biomass may be dried to constant weight at a temperature from 80-150° C., from 90-125° C., or from 100-110° C.

In some implementations the biomass may be extracted with a solvent prior to combination with the compound of Formula (1). The biomass may be contacted with a polar protic solvent, e.g., water, a $C_{1-4}$alcohol, a $C_{1-4}$carboxylic acid, or combination thereof, to remove extractables. In certain implementations the solvent is ethanol. In certain implementations the biomass is washed with the solvent. In certain implementations the biomass is subjected to Soxhlet extraction with the solvent.

EXAMPLES

The following examples are for the purpose of illustration of the invention only and are not intended to limit the scope of the present invention in any manner whatsoever.

Example 1—Heterogeneous Catalyst

A 10 wt. % (w.r.t. solvent) mixture of biomass (pine) in 1,3-dimethoxypropan-2-ol was combined with Pd/C (10 wt. % w.r.t biomass) in a heavy wall borosilicate tube. The tube was capped and the mixture was maintained at 200° C. for 7 hours The resulting black liquor was separated from the solids via vacuum filtration. After filtration, residual pulps was washed with organic solvent (e.g., isopropyl alcohol, acetone), water, and then dried in an oven (~90° C.). The filtrated black liquor was washed deionized water at room temperature and then the black liquor was distilled under vacuum (80 to 100° C., 15 to 30 in. Hg) to remove solvents. After vacuum distillation, the bottoms consist of a black liquor comprised of a mixture of lignin compounds. The delignification yield was 79.1 wt. %, the lignin monomer yield was 21.4 wt. %.

Example 2—Homogeneous Catalyst

A 10 wt. % (w.r.t. solvent) mixture of biomass (pine) in 1,3-diethoxypropan-2-ol/water (90/10 v/v) was combined with 0.2 N H2SO4 in a heavy wall borosilicate tube. The tube was capped and the mixture was maintained at 120° C. for 1 hour, and then worked up as in Example 1. The delignification yield was 71.7 wt. %.

Example 3

(±)-Epichlorohydrin (99%) and 2-methoxyethanol (99%) were purchased from BeanTown Chemical; tetrahydrofuran (THF, 99% min) was provided by Mallinckrodt Chemicals; toluene (99.8%) and bromoethane (98%) were purchased from Alfa Aesar; molecular sieves (3 Å, 3.2 mm pellets) were supplied by Sigma-Aldrich; magnesium sulfate (99.8%, anhydrous) was obtained from J. T. Baker; ACS grade methanol (MeOH), ethanol (EtOH), 2-propanol (2-PrOH) and dichloromethane ($CH_2Cl_2$) were supplied by VWR; 2,2,2-trifluoroethanol was provided by Oakwood Chemical; toluene (99.8%) and sodium sticks (99%, in mineral oil) were obtained from Alfa Aesar. 1,3-dimethoxypropan-2-ol (DMP, ≥99%), 1,3-diethoxypropan-2-ol (DEP, ≥99%), 1,2,3-triethoxypropane (TEP, ≥99%), and were synthesized following established protocols.[31,34] Ethanol, acetone (ACS Grade), and isopropyl alcohol (ACS Grade) were purchased from Sigma-Aldrich and used as received. Deionized water (18 mn) was obtained with an ELGA Purelab Flex system (ELGA LabWater). Glycerol (GLY, ≥99%), deuterated dimethyl sulfoxide (DMSO-$d_6$, 99.8% min with 0.03 vol % TMS) was purchased from VWR Chemicals and used as received. Sulfuric acid (72% w/w and 5N) was purchased from Thermo Scientific. Helium (99.9%) was purchased from Airgas and used as received. Lodgepole pine chips were procured from the Idaho National Laboratory Bioenergy Feedstock Library.

1,3-Dimethoxypropan-2-ol (DMP): 24.15 g of sodium metal was dissolved in a chilled (0° C.) 200 mL volume of MeOH, with the solution heated to 50° C. to ensure complete sodium dissolution in the alcohol. Subsequently, 46.26 g of epichlorohydrin was added dropwise to the solution and then refluxed overnight. Excess MeOH was evaporated off and 300 ml of $CH_2Cl_2$ was added to extract the DMP which was then washed with 50 mL deionized water five times, dried over anhydrous $MgSO_4$, distilled, and stored over molecular sieves.[31]

1,3-Diethoxypropan-2-ol (DEP): The strategy that was used for DMP was also implemented for synthesizing DEP, but EtOH was used instead of MeOH to dissolve the sodium metal before adding epichlorohydrin.

1,2,3-Triethoxypropane (TEP): For TEP, a two-step strategy was employed where DEP was first synthesized as described earlier in the first step. In the second step, 0.30 mol of the as-synthesized DEP was dissolved in 100 ml of THF, 0.45 mol of NaOH was added before the quick addition of 0.60 mol bromoethane, the pressure flask sealed and reacted overnight at 80° C. Similar workup, distillation, and storage used for the DMP and DEP were also implemented for the TEP with one change: the TEP was extracted with 300 mL of $CH_2Cl_2$ and washed with 3×50 mL brine first then washed with 3×50 mL DI water before drying, distillation and storage.

Th properties of the solvents are presented below:

| Solvent | Molar Volume ($cm^3$ $mol^{-1}$) | Density (g $cm^{-3}$) | Dynamic Viscosity (mPa s) | Boiling Point (° C.) |
|---|---|---|---|---|
| GLY | 73.04 | 1.26 | 1,412 | 290 |
| DMP | 118.81 | 1.01 | 3.52 | 170 |
| DEP | 155.99 | 0.95 | 3.93 | 188 |
| TEP | 198.11 | 0.89 | 1.53 | 177 |

Lodgepole pine chips (≤2 mm in size) were dried in the vacuum oven (Thermo Scientific, model 3608) at 105° C. for approximately 15 hours to a constant weight, and the moisture content of the pine chips was estimated. Also, extractives were estimated after Soxhlet extraction with ethanol; the ash content estimate and the biochemical composition were the same as those already calculated in our previous work (*Chem Eng Sci* 2024, 288, 119808).

Extract-free lodgepole pine chips were micronized via a KA MultiDrive Basic Grinding Mill (IKA, USA) using the following milling protocol: the working speed of the mill was set at 20,000 rpm, and the milling time set for 15 minutes (5 min×3) and 10 minutes rest period using the interval method. The milled extract-free pine chips were subsequently sieved into different particle size fractions using SP Bel-Art Scienceware micro sieves (SP Bel-Art, USA). Four different US mesh sizes were selected: 25, 35, 60, and 120 to give distinct particle sizes (>707, 500-707, 250-500, 125-250, and <125 μm).

Organosolv processing was conducted in heavy wall, borosilicate test tubes (Ace Glass, USA). In a typical experiment, 360 mg of milled dried extract-free pine chips were loaded in a reactor with 3 mL of solvent and a ⅝×5/16" stir bar (VWR, USA); biomass loadings comprised 12 wt % of all materials loaded into the reactors. Glass tubes were sealed with a head assembly containing a ball valve and analog pressure gauge. The headspace of the reactor was evacuated by connecting the reactor to the in-house vacuum line for 5 min and was then pressurized with 2 bar helium for 5 minutes. The ball valve was then sealed and subsequently, the reactor disconnected from the gas line and placed in a silicone oil bath that was preheated by a hot plate stirrer (VWR Advance) to the setpoint temperature (120-180° C.) under magnetic mixing set at 1000 rpm. The heat-up period was estimated with the help of a timer (stopwatch) to be 15-20 minutes for each experiment after the reactor was placed in the oil bath. Subsequently, after the desired temperature was obtained, the reaction was allowed to proceed for the desired amount of time before being removed from the oil bath. The reaction mixture was immediately filtered using vacuum filtration glassware, which facilitated separation of the product matrix into solid residue (residual pulp) and black liquor (liquid organic extract). The organic extract was carefully transferred and stored in a scintillation vial. The solid residues were rinsed with 50 ml of distilled water before they were placed in a drying oven at 105° C. Organic extracts were diluted tenfold with deionized water to precipitate dissolved lignins. The solution was allowed to settle overnight under refrigeration (−4° C.) before subsequently being centrifuged at 10,000 rpm for 10 minutes using an Allegra X-30R Centrifuge (Beckman Coulter, USA). After centrifugation, excess water and solvent were decanted to isolate the lignin precipitates. Coagulated lignin precipitates were rinsed with deionized water several times to remove solvent residues and lyophilized overnight to obtain dry, organosolv lignin samples for analysis.

Yields of the residual pulps were evaluated as the quotient of the mass of the dried pulp divided by the mass of the dried, extract-free pine chips loaded into the batch reactor. The degree of delignification (DD) of the pine chips was evaluated as the difference between the mass of lignin present in the dried, extract-free pine chips and the mass the lignin in the residual pulps divided by mass of lignin present in the dried, extract-free pine chips. Delignification selectivity (DS) of the pine chips was also calculated as the difference between the mass of lignin present in the dried, extract-free pine chips and the mass the lignin in the residual pulps divided by the difference between the mass of the dried, extract-free pine chips and the mass of the residual pulp. Holocellulose content (g/g) of the residual pulp was estimated according to the formula: 1-lignin content where lignin content is determined by the mass of acid insoluble lignin/mass of dried, extract free pine chips or residual pulp.

The influence of solvent speciation on the delignification of lodgepole pine was evaluated by benchmarking the performance of solvent candidates. Ideally, effective solvents will maintain appreciable pulp yields consisting of intact carbohydrate fractions while selectively fractionating and solubilizing lignins. Pulp yields and delignification resulting from GDE organosolv processing of lodgepole pine are offered in FIG. 1*a*. Organosolv was conducted with 90 vol % GDE/10 vol % aqueous co-solvent, 12 wt % biomass, 20 mN sulfuric acid, at 150° C. for 60 min. Glycerol diethers demonstrated the highest delignification as DMP organosolv promoted 0.700±0.0328 g/g delignification while DEP organosolv facilitated 0.597±0.0160 g/g. Glycerol organosolv facilitated delignification of 0.495±0.0467 g/g, while TEP (i.e., triether) organosolv resulted with the lowest delignification, 0.307±0.0004 g/g. Pulp yields were inversely proportional to delignification as DMP and DEP had the lowest pulp yields, 0.526±0.0269 g/g and 0.537±0.0839 g/g, respectively, while glycerol and TEP organosolv had pulp yields of 0.590±0.0533 g/g and 0.612±0.0219 g/g, respectively. Observed differences in delignification amongst the solvent candidates can be attributed to the influence of the degree of derivatization and structure of alkyl side chains on solvation properties.

Figure 1B:
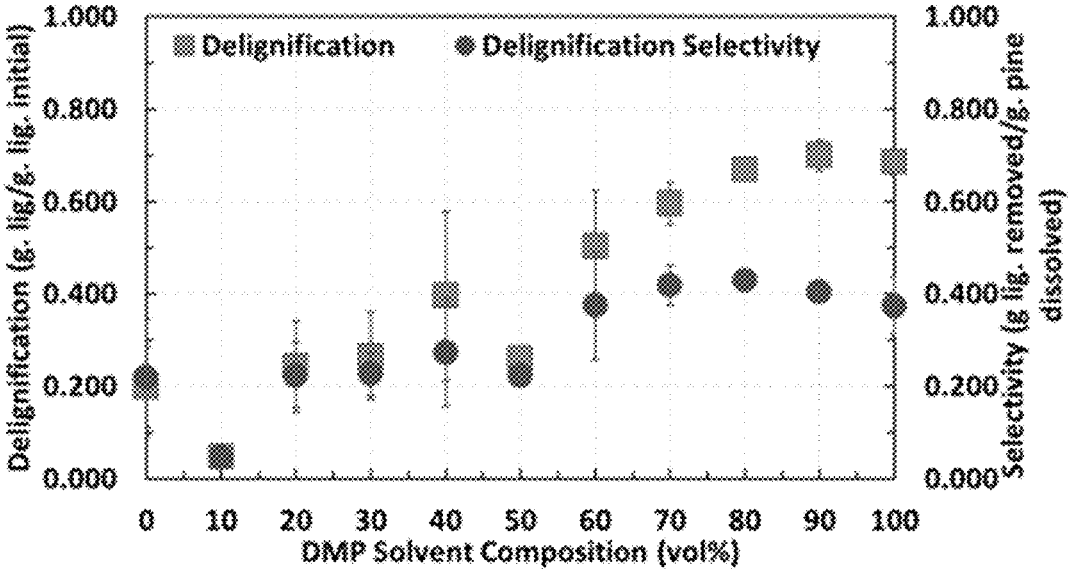

Furthermore, including aqueous co-solvent in GDE organosolv of lodgepole pine was evaluated by conducting organosolv with varying relative volumes of DMP and deionized water. While GDEs consist of biogenic carbon, increasing relative volumes of aqueous co-solvent can further promote process sustainability by reducing the organic solvent intensity and reducing operational expenditures as water is inexpensive. Click or tap here to enter text. To this effect, the impact of relative solvent volumes on organosolv delignification was evaluated for solvent mixtures comprised of solely water (100 vol % $H_2O$), intermediate compositions of DMP and water (10 vol % to 90 vol % DMP), and solely DMP (100 vol % DMP). Organosolv treatments were conducted at 150° C., 60 minutes, 12 wt % biomass loading, and 20 mN sulfuric acid. As shown by FIG. 1*b*, delignification increases from 0.048±0.0162 g/to 0.700±0.0328 g/g as relative DMP volumes increase from 10 vol % to 90 vol %, then level off as DMP volumes proceed to 100 vol %. Selectivity for lignin extraction increased to ~0.4 g lig./g wood as DMP volumes approached 70 vol % and remained steady at DMP volumes reached 100 vol %. Overall, modest addition of water positively affects lignin extraction, while further addition of water suppresses, indicating optimal co-solvency behavior of DMP and water. This observation is consistent with Meng and colleagues, who reported the dissolution of organosolv lignin in aqueous solutions of Cyrene, where lignin dissolution increased up to 80 vol % of Cyrene and then decreased.

Relationships between molecular structures and miscibility of mixtures can be interrogated through Hansen solubility parameters (HSP), which have been applied previously to evaluate the efficacy of solvents towards solubilizing lignins and plastic materials. Briefly, HSPs can be leveraged to evaluate contributions by dispersion, dipole-dipole, and H-bonding interactions to facilitate (im)miscibility of polymers in solution. Soyemi and Szilvási (*Ind Eng Chem Res* 2022, 62, 6322-6337) recently calculated HSP values for glycerol-derived solvents and these HSP values were applied in the present study to interpret the influence of solvent structure on the delignification of raw biomass. The ability of solvents to solubilize specific polymers can be evaluated by calculating the relative energy difference (RED) between the polymer and solvent, as defined by Eq. 6:

$$RED = \frac{R_a}{R_0} \tag{6}$$

where $R_0$ is the radius parameter of the polymer (this value is given as 13.7 for milled wood lignin, MWL) and $R_a$ is taken as the "geometric distance" between the solvent (1) and the polymer (2), as given by Eq. 7:

$$R_a = \sqrt{4(\delta_{D2} - \delta_{D1})^2 + (\delta_{P2} - \delta_{P1})^2 + (\delta_{H2} - \delta_{H1})^2} \tag{7}$$

where $\delta_{Di}$ ($MPa^{1/2}$) are the dispersion contributions, $\delta_{Pi}$ ($MPa^{1/2}$) are the dipole-dipole interaction contributions and $\delta_{Hi}$ ($MPa^{1/2}$) are the hydrogen bonding interaction contributions of the solvent (1) and polymer (2). When RED<1, solvent and polymer are projected to have favorable interactions and form miscible solution. To this end, RED values between lignin and different GDE-aqueous co-solvent combinations were calculated.

Figure 2A:
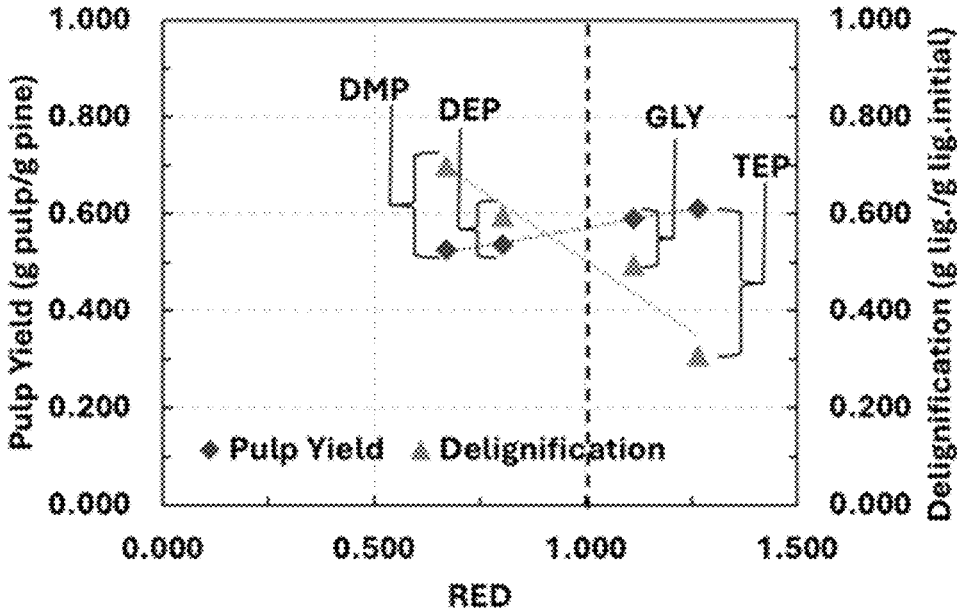
FIGS. 2A and 2B depict plots showing the influence of (A) GDE solvent candidate RED values and (B) DMP aqueous mixture RED values on pulp yield and delignification. Organosolv treatments were conducted at 150° C., 60 min, 2 bar He (RT), 12 wt % biomass, 90% solvent and 20 mN $H_2SO_4$ (FIG. 2A) and 150° C., 60 min, 2 bar He (RT), 12 wt % biomass, 20 mN $H_2SO_4$, GDE relative volumes (0-100 vol %) (FIG. 2B). Dotted continuous curves are graphical aids to aid readers in visualizing trends in the scatter plots. Vertical dotted lines represent the RED value of 1.

Relationships between calculated RED values and GDE organosolv (e.g., pulp yield, delignification) are offered by FIG. 2*a*. Amongst the solvent candidates, only DMP and DEP aqueous mixtures (90 vol % GDE, 10 vol % aq.) had RED values less than 1. DMP aqueous solvent mixtures had the lowest RED value, 0.669, followed by DEP, 0.804, GLY, 1.11, and finally, TEP, 1.27. As evidenced in FIG. 2*a*, decreasing RED values corresponded with increasing pulp yield and decreasing delignification, which is consistent with established interpretations of RED (i.e., lower polymer solubility for RED>1). The relative degree of each individual contributions to the RED values can facilitate insights on interactions promoting co-solvency of lignins. As an interaction group, dispersion contribution values are closest between those estimated for lignin (21.90 $MPa^{1/2}$), water (15.50 $MPa^{1/2}$) and the solvent candidates (15.50 to 18.01 $MPa^{1/2}$). Wider range in discrepancy exists for estimated contributions by dipole-dipole interactions between lignin (14.10 $MPa^{1/2}$), water (16.00 $MPa^{1/2}$) and the solvent candidates (5.30 to 11.30 $MPa^{1/2}$; increasing by decreasing degree of etherification). However, large differences in contribution values for H-bonding interactions between solvent candidates and lignin facilitated their incompatibility. For instance, estimated H-bonding contributions for lignin and the solvent candidates: glycerol (27.20 $MPa^{1/2}$) and TEP (4.3 $MPa^{1/2}$) were wide in the margin, corresponding to their poor organosolv performances. However, DMP (14.07 $MPa^{1/2}$) and DEP (11.76 $MPa^{1/2}$) were closer in value to lignin, corresponding to their superior ability to extract lignins.

Figure 2B:
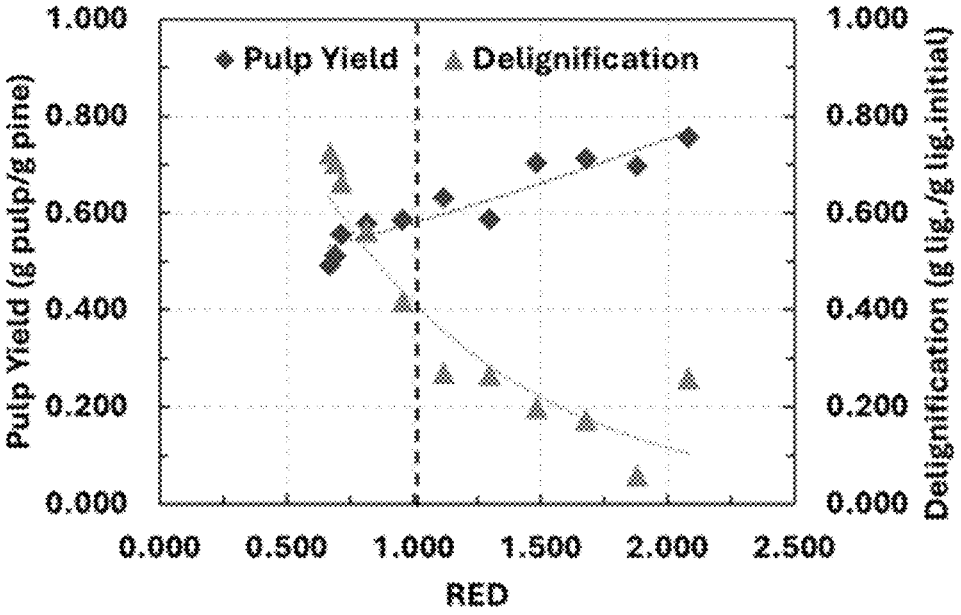
Figure 3A:
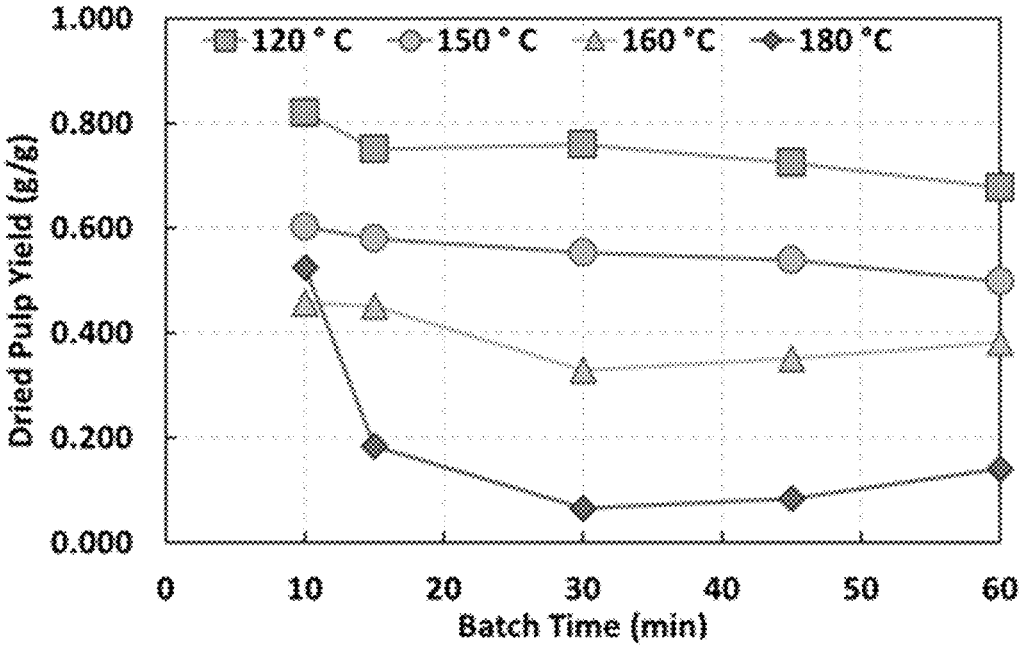
FIGS. 3A, 3B, 3C, and 3D depict scatter plots demonstrating the influence of organosolv conditions on (FIG. 3A) pulp yield, (FIG. 3B) delignification, (FIG. 3C) pulp yield, and (FIG. 3D) holocellulose content of the residual pulp. Organosolv was conducted for 60 min and consisted of 12 wt % biomass, 90 vol % DMP/10 vol % aq., 20 mN $H_2SO_4$, and 2 bar He (RT). Black diamonds represent 180° C., orange triangles represent 160° C., green circles represent 150° C., and blue squares represent 120° C.
Figure 3B:
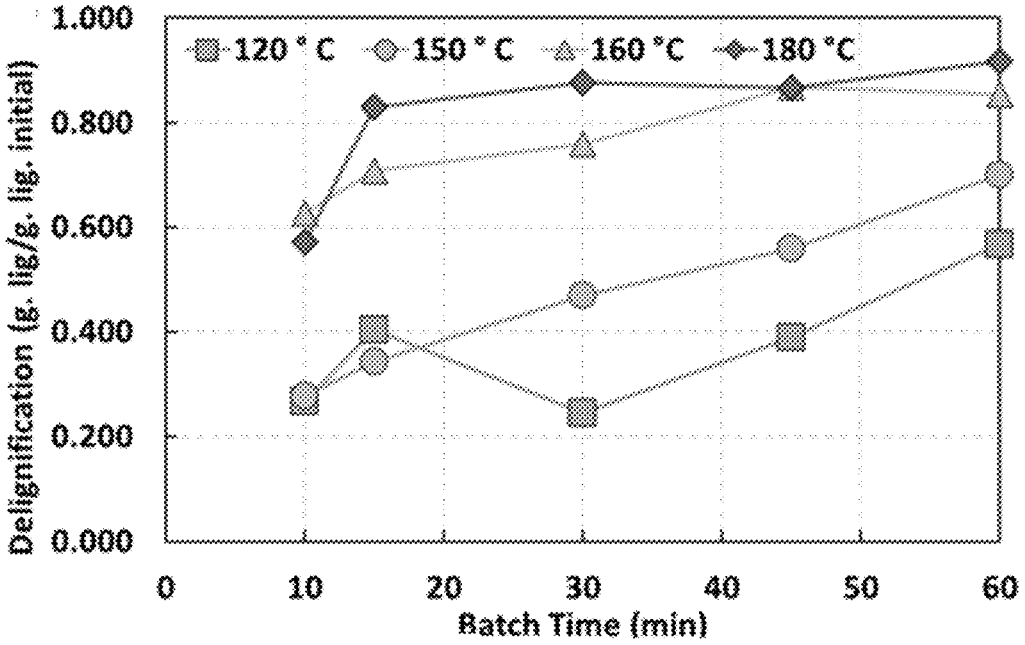
Figure 3C:
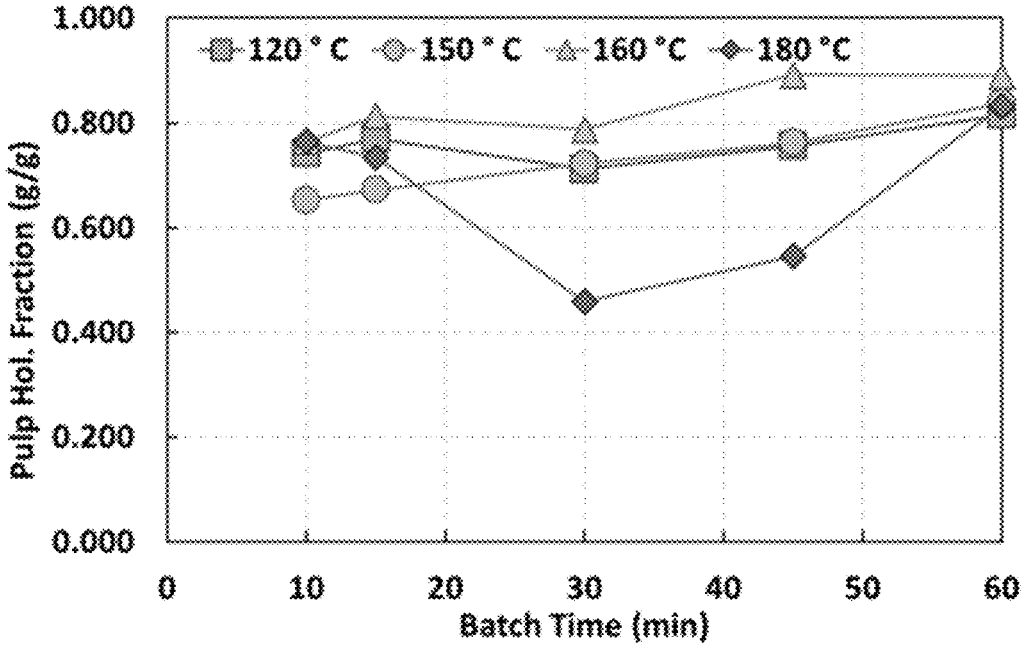
Figure 3D:
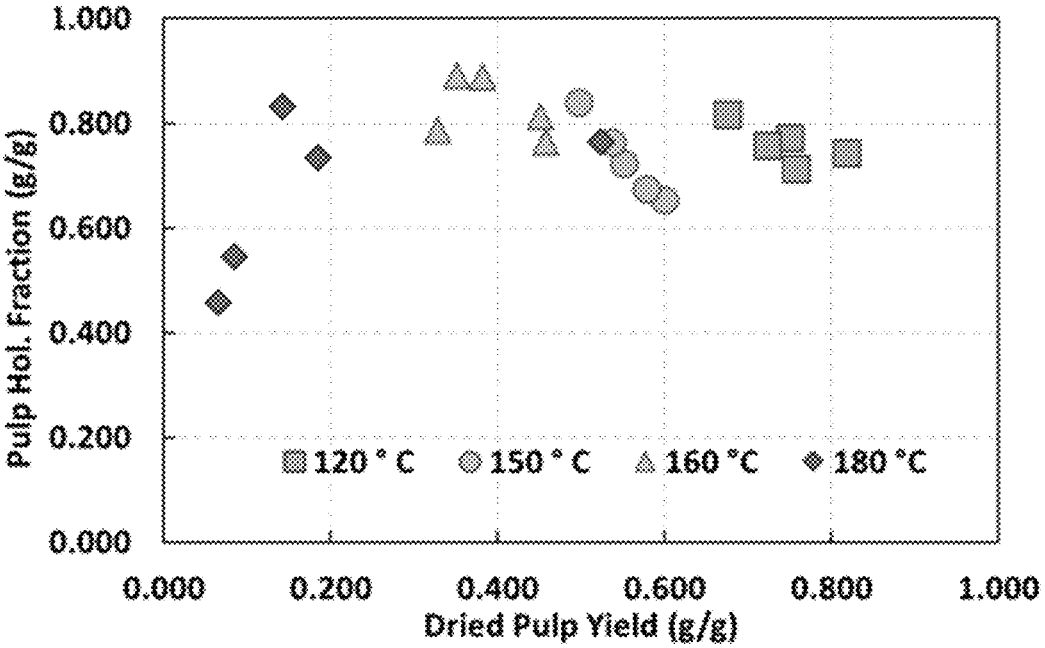

Similarly, RED values for the varying volumes of DMP and aqueous co-solvent (0-100 vol %) were calculated to evaluate the impacts of relative solvent volumes on pulp yield and delignification. As shown by FIG. 2*b*, as DMP volumes decrease from 100 vol % to 10 vol %, RED values increase from ~0.7 to ~1.9. As RED values of the DMP aqueous co-solvent mixtures increased, pulp yields increased while delignification decreased. As dispersion and dipole-dipole interaction contributions are similar between lignin, water, and DMP, the degree of lignin extraction by DMP/water mixtures is modulated by H-bonding interaction contributions, as the contribution by water (42.30 $MPa^{1/2}$) is much higher than values estimated for lignin (16.90 $MPa^{1/2}$) and DMP (14.07 $MPa^{1/2}$). As DMP volumes decrease, H-bonding interactions rise as the contribution of water H-bonding dominates, thus leading to larger RED values which correspond to lower delignification. As such, DMP (90 vol %) aqueous co-solvent (10 vol %) was chosen as the optimum solvent mixture and subsequently applied to evaluate process conditions.

The influence of process conditions, namely, temperature and time, on pulp yields and delignification resulting from DMP organosolv of lodgepole pine are offered in FIG. 3. Dried pulp yields decreased, and delignification increased with increasing temperature and time, which is consistent with the previous literature reports Pulp yields decreased with increasing process intensity due to lignin removal and deconstruction of carbohydrate fractions (FIG. 3*a*). The highest degree of delignification, 0.918 g/g, was observed at 180° C. and 60 minutes (FIG. 3*b*), however, low pulp yields (<20 wt %) were observed under this condition likely due to deconstruction of carbohydrate fractions. Correspondingly, holocellulose content of the residual pulp is the lowest for organosolv performed at 180° C. between 30 and 40 minutes, which indicates deconstruction of carbohydrate fractions at elevated temperatures, as shown in FIGS. 3*c* and 3*d*. Ideally, organosolv treatments should provide a balance of removing lignins while maintaining intact pulps enriched with carbohydrates. In this lens, optimal conditions for conducting DMP organosolv are 150° C. for 60 minutes, which provides balance in delignification, (0.700 g lig./g lig. int.), pulp yield (0.498 g pulp/g wood), and holocellulose composition (0.838 g holo./g pulp). Impacts of sulfuric acid concentration on pulp yield and delignification are offered in FIG. S4. Briefly, a parabolic trend exists between sulfuric acid concentration and delignification as delignification increases with increasing acid concentration until reaching a maxima observed at 20 mN, after which further increased acid concentration promotes lignin condensation and lower net delignification.

Figure 4A:
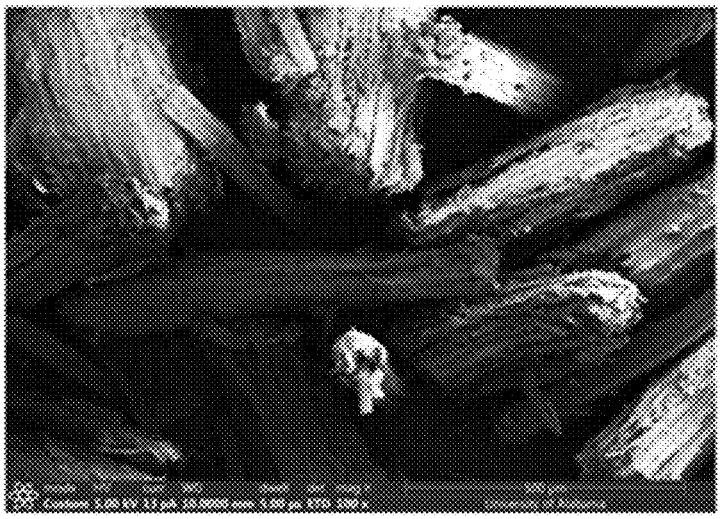
FIGS. 4A, 4B, 4C, 4D, 4E, and 4F depict SEM micrographs (100× magnification) showing the effects of solvent speciation and GDE concentration on the micronization of lodgepole pine. SEM micrographs include (FIG. 4A) extract-free pine, and residual pulps produced by organosolv using (FIG. 4B) 90 vol % DEP, (FIG. 4C) 90 vol % TEP, (FIG. 4D) 100 vol % aqueous, (FIG. 4E) 60 vol % DMP, and (FIG. 4F) 90 vol % DMP. Organosolv treatments were conducted at 150° C. for 60 min and consisted of 12 wt % biomass, 0-90 vol % GDE (balance aqueous co-solvent), 20 mN $H_2SO_4$, and 2 bar He (RT).
Figure 4B:
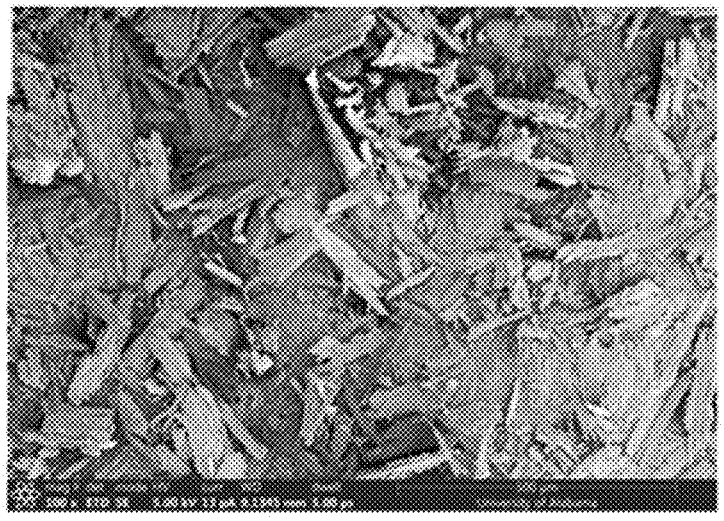
Figure 4C:
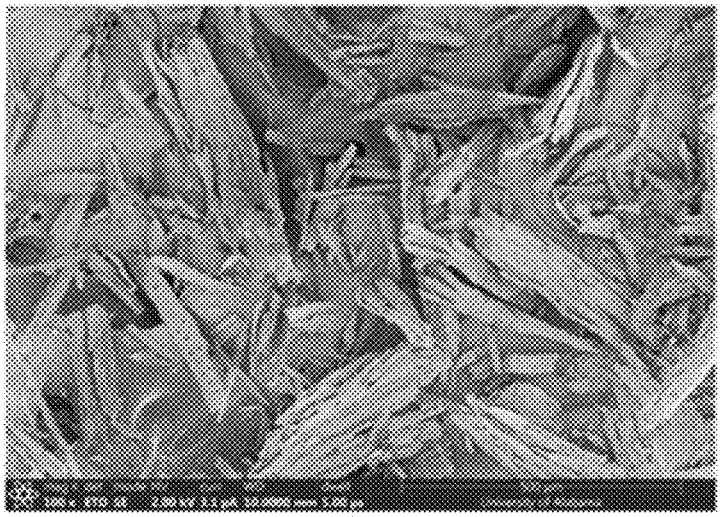
Figure 4D:
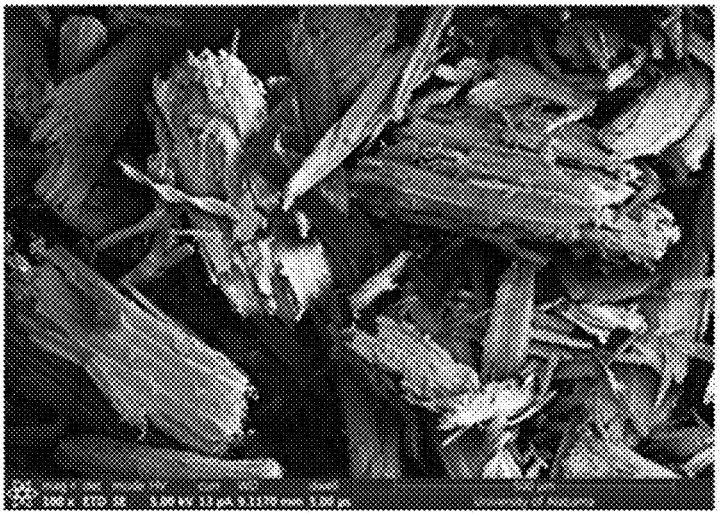
Figure 4E:
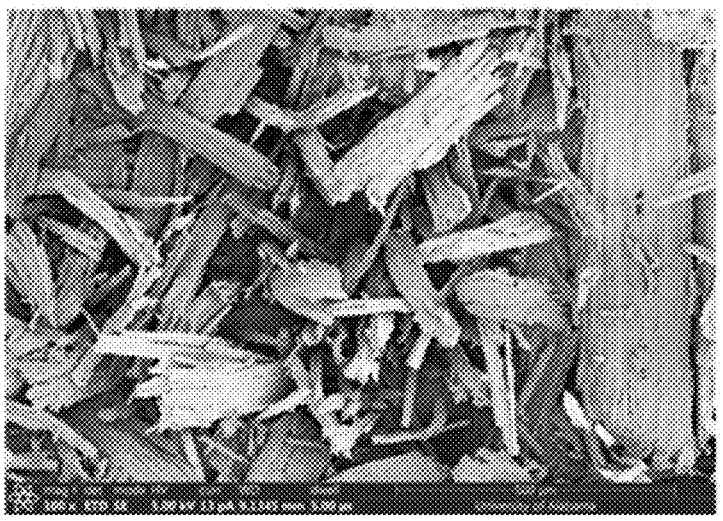
Figure 4F:
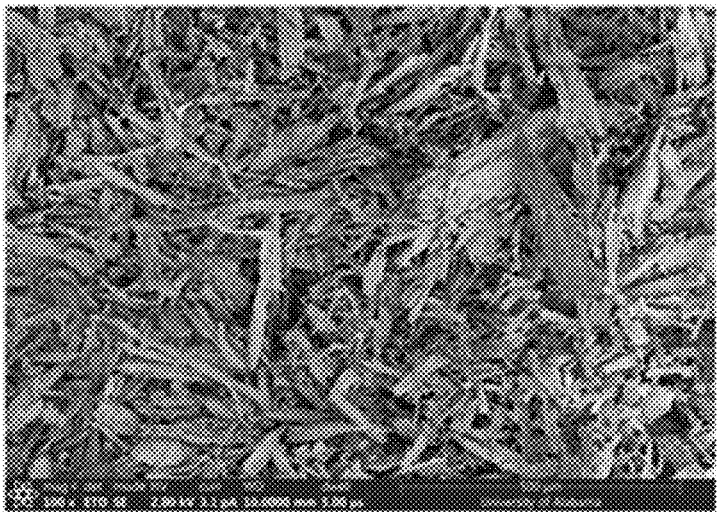

SEM of the residual pulps was conducted to evaluate the influence of solvent composition on the physical deconstruction of lignocellulosic feedstocks. As shown in FIG. 4, increasing relative solvent volumes of DMP promoted the chemical micronization of lignocellulosic substrates. For instance, aqueous treatment of lodge pole pine (i.e., 0 vol % DMP, FIG. 4*d*) produced pulps with intact fibrous structures like the raw biomass (FIG. 4*a*). However, defibrillation and deconstruction of the lignocellulosic matrix were observed as DMP relative volumes increased to 60 vol % (FIGS. 4*e*) and 90 vol % (FIG. 4*f*). Smaller particle sizes of lignocellulosic fibers were observed as DMP relative volumes increased, which would correspond to increased surface area exposed to the reactive environment; these trends corroborate previous observations for increased DMP content leading to increased delignification and decreased dried pulp yields. Comparatively, lignocellulosic fibers were still intact after pretreatment with 90 vol % DEP and 90 vol % TEP (FIGS. 4*b* and 4*c*), which corresponds with the observed lower delignification obtained using these solvents. These trends were consistent with previous reports for GO pretreatments. Sun and coworkers reported defibrillation and physical shortening of wheat straw fibers caused by permeation into the biomass fiber and subsequent dissolution of lignin and other biochemical components by the solvent after pretreatment with aqueous glycerol under autocatalytic conditions. Also, we previously reported that for organosolv treatments comprising polar aprotic solvents and organic base additives, organic solvents with lower molar volumes produced pulps with smaller particle sizes. Hence, DMP with a lower molar volume (118.81 $cm^3$ $mol^{-1}$) than DEP (155.99 $cm^3$ $mol^{-1}$) and TEP (198.11 $cm^3$ $mol^{-1}$) was able to penetrate deeper into the fibers of the pine than the other solvents and promote micronization.

Figure 5:
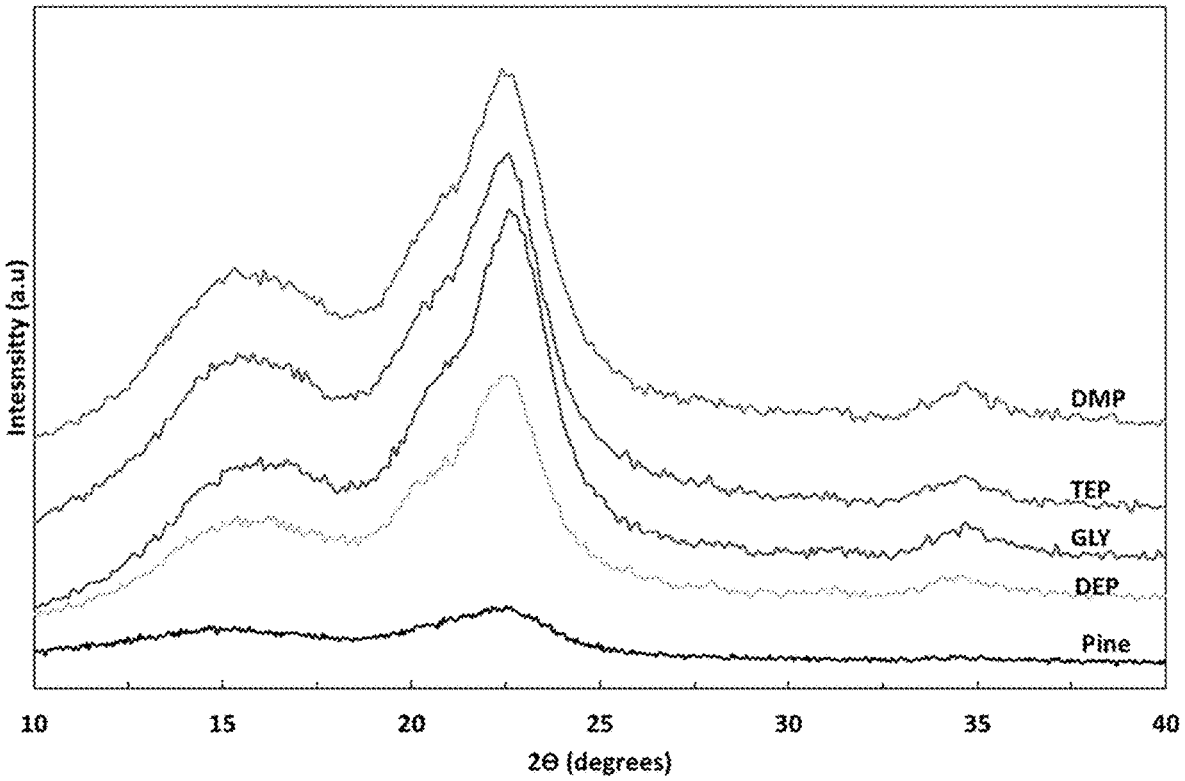
FIG. 5 depicts XRD diffractograms of residual pulps resulting from organosolv treatment using DEP (yellow), GLY (red), TEP (blue), and DMP (green) along with extract-free lodgepole pine (black). Organosolv treatments were conducted at 150° C. for 60 min using 12 wt % biomass, 20 mN $H_2SO_4$, and 2 bar helium.

The influence of solvent candidates on the crystallographic characteristics of the residual pulps produced at 150° C. for 60 min was analyzed by XRD and resultant diffractograms are provided in FIG. 5. Amongst lignocellulosic polymers, cellulose contributes crystalline domains while lignin and hemicellulose are amorphous. As such, XRD intensities of biomass and residual pulps arise from crystalline regions of cellulose. XRD diffractogram patterns consisting of intensities at 15°, 16.5°, 22.5°, and 35°, are observed for untreated biomass and all the residual pulps. This diffractogram pattern is the feature of the crystallographic lattice planes of (1-10), (110), and (200), (040), respectively, which are indicative of cellulose polymorph Ip. Diffractogram intensities for residual pulps produced by DEP organosolv treatments are less intense than those resulting from glycerol, DMP, and TEP organosolv. Decreased crystallinity of DEP pulps is corroborated by subsequent FTIR measurements which indicate DEP pulps have larger presence of lignin in comparison to the other GDE organosolv pulps. Shouldering at 20.25° is also observed for all the samples, excluding DEP, which is characteristic of the crystallographic plane of (002) for cellulose polymorph $I_\alpha$.

Figure 6A:
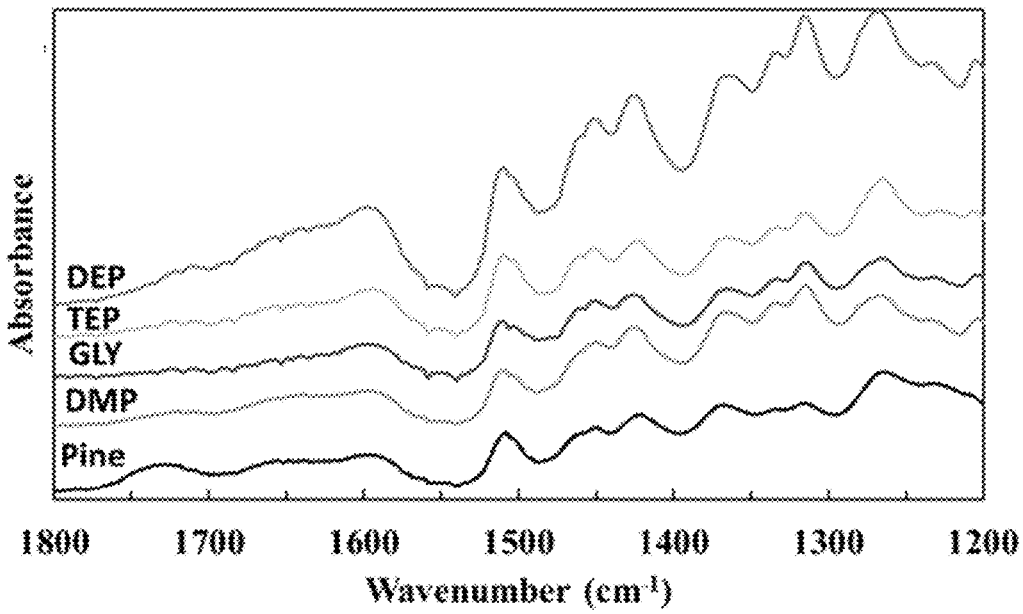
FIGS. 6A, 6B, 6C, and 6D depict molecular characterization of the residual pulps with ATR-FTIR showing the impact of (FIG. 6A) and (FIG. 6B) the solvent species and (FIG. 6C) and (FIG. 6D) DMP concentration on pulp features. Organosolv treatments were conducted at 150° C. for 60 min and consisted of 12 wt % biomass, 0-90 vol % GDE, 20 mN $H_2SO_4$ and 2 bar He.
Figure 6B:
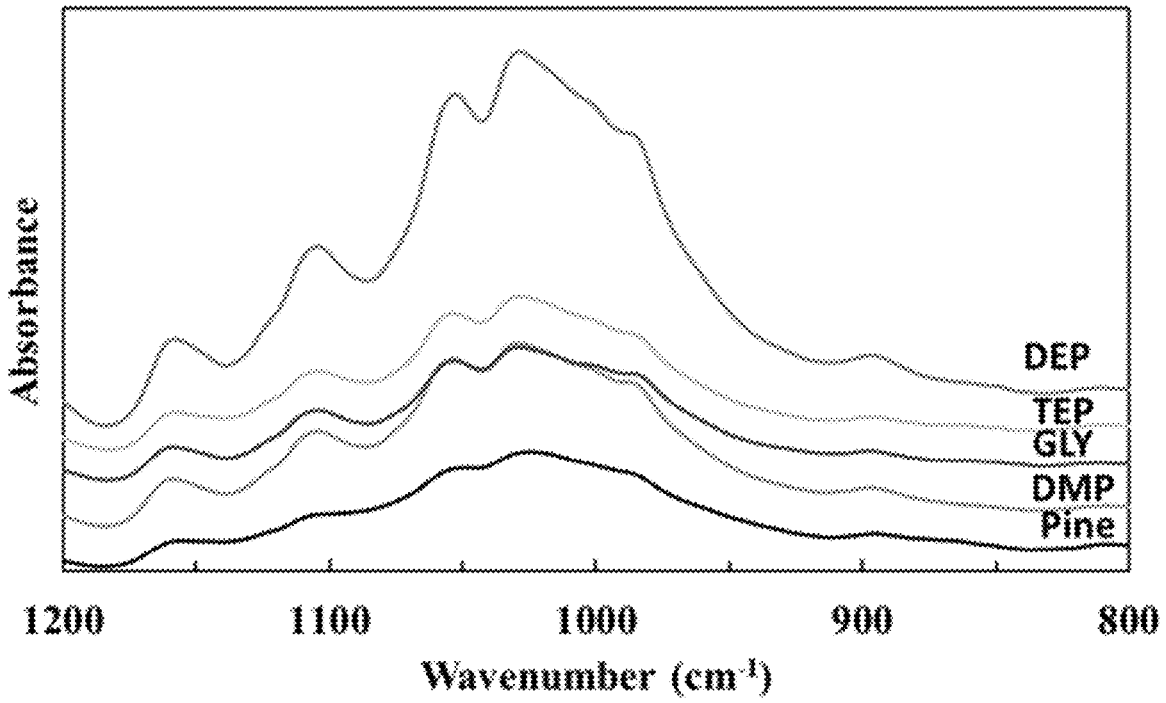
Figure 6C:
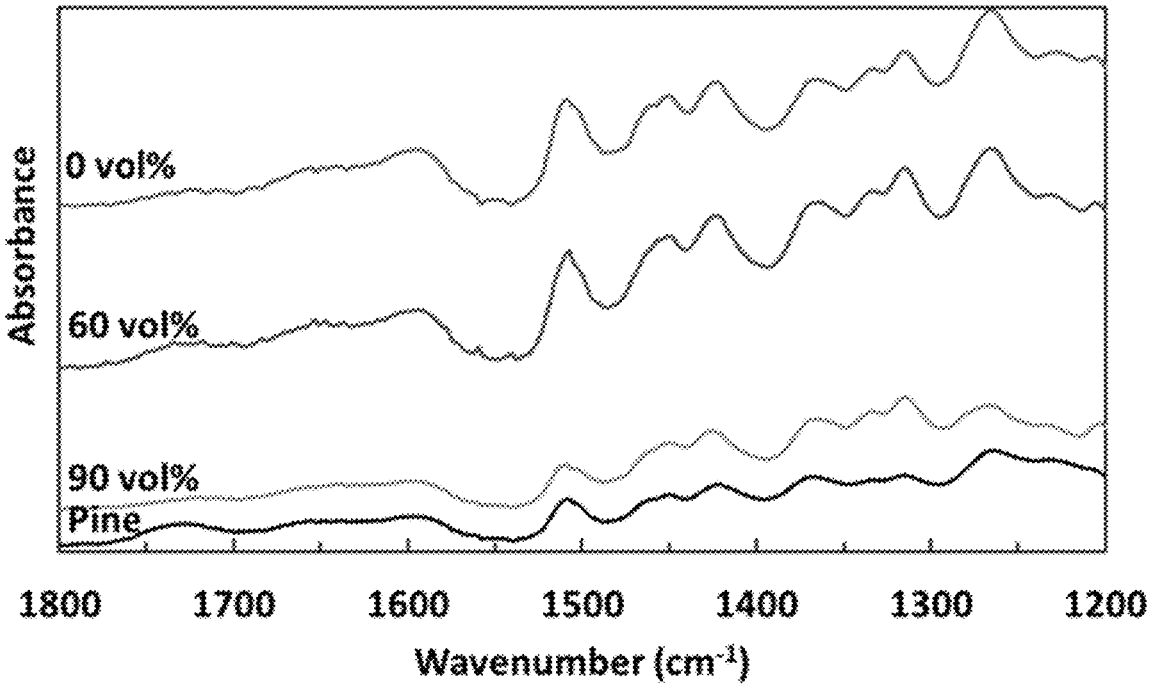
Figure 6D:
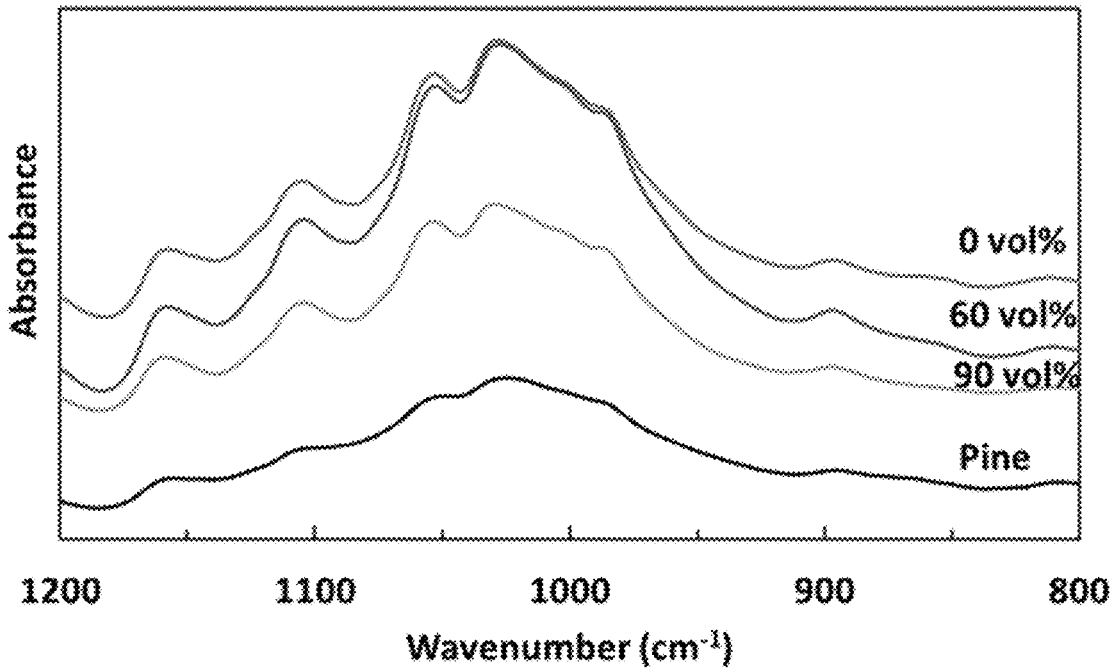
Figure 7A:
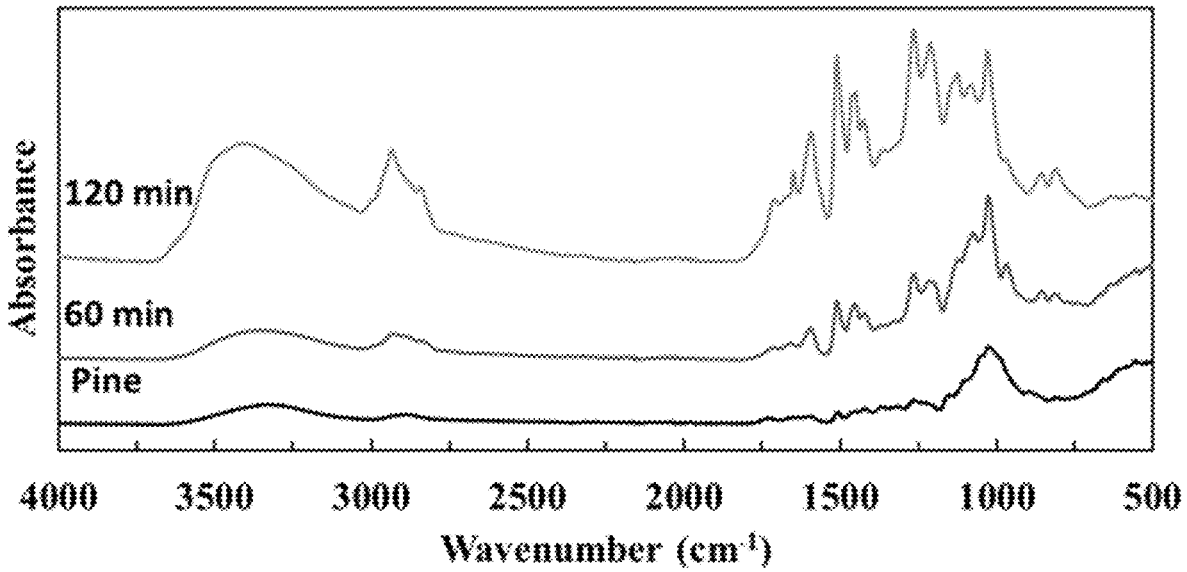
FIGS. 7A and 7B depict molecular characterization of precipitated lignin samples (A) full spectra (4000-500 $cm^{-1}$) and (B) fingerprint region (1800-600 $cm^{-1}$). Organosolv treatments were conducted at 150° C. and the solution consisted of 12 wt % biomass, 90 vol % DMP/10 vol % aq., 20 mN $H_2SO_4$, and 2 bar He (RT), with batch holding times of either 60 min or 120 min.

The influence of solvent speciation and organosolv conditions on the molecular characteristics of the residual pulps were analyzed with ATR FTIR spectroscopy, in the fingerprint region (1800-800 $cm^{-1}$) which we further subdivided into the hemicellulose and lignin region (FIGS. 6*a* and 6*c*, 1800-1200 $cm^{-1}$) and cellulose region (FIGS. 6*b* and 6*d*, 1200-800 $cm^{-1}$). As shown in FIG. 7*a*, the absorption band at 1730 $cm^{-1}$ indicative of C═O stretching by hemicellulose, was not present for DMP and GLY pulps and had reduced intensities for TEP and DEP pulps, demonstrating that hemicellulose is completely dissolved by DMP and GLY while partially dissolved by DEP and TEP. Also, FIG. 6*c* indicates reduced intensity of the hemicellulose stretching band was more pronounced for 90 vol % DMP (almost complete disappearance) than solvent mixtures with higher relative volumes of water (e.g., 60 vol % DMP, 0 vol % DMP). Complete hemicellulose extraction via organosolv can occur at short batch holding times (<15 min). Incomplete dissolution of hemicellulose even at long batch times (60 min) by all solvent systems studied in the present work are attributable to mild temperature conditions (150° C.) used in this study, compared to the relatively high temperature (200° C.) in our previous work. Intensities at 1590 $cm^{-1}$, 1510 $cm^{-1}$ (aromatic skeletal vibrations of lignin), 1458 $cm^{-1}$(asymmetric bending of methoxyl groups), 1420 $cm^{-1}$ (aromatic skeletal vibrations and C—H deformation), and 1225 $cm^{-1}$ (aromatic vibrations of guaiacyl rings) all showed reduced intensities for the 90 vol % DMP and GLY samples, which are signs of effective delignification. However, these lignin bands were present with higher intensities for pulps resulting from TEP, DEP, 60 vol % DMP, and 0 vol % DMP organosolv treatments. In the cellulose region (FIGS. 6*b* and 6*d*), residual pulps demonstrated an increase in band intensities at 1185 $cm^{-1}$ (C—O stretching in cellulose), 1105 $cm^{-1}$ (C—O—C bending in cellulose and hemicellulose), 1055 $cm^{-1}$ (C—O stretching of secondary alcohols in cellulose), and 1025 $cm^{-1}$ (C—O bending in primary alcohols in cellulose), thus indicating enrichment of pulps with carbohydrates. DEP pulp has the highest intensity of bands associated with hemicellulose (FIG. 6*b*, 1105 $cm^{-1}$, C—O—C) and lignin (FIG. 6*a*, 1510 $cm^{-1}$, C═C stretching of the aromatic ring), which is consistent with DEP pulp having lower crystallinity intensities by XRD as these biopolymers are amorphous.

Figure 7B:
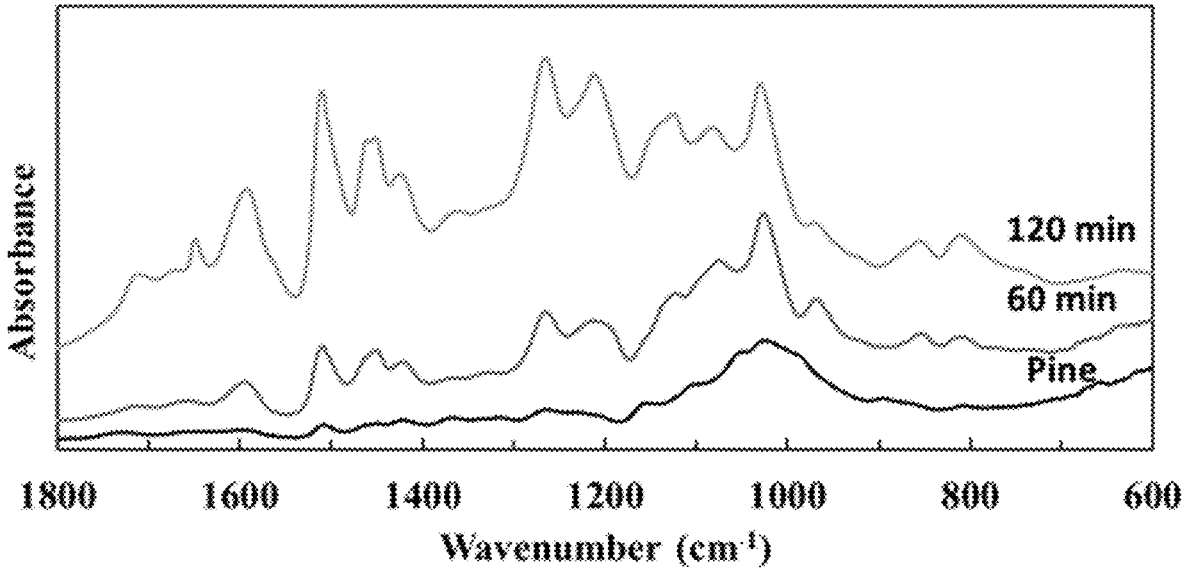

The influence of process conditions of DMP organosolv on the molecular structures of isolated lignins was evaluated by ATR FTIR spectroscopy, as shown in FIG. 7. Isolated lignins were produced from organosolv treatments conducted at 150° C., 12 wt % biomass loading, 90 vol % DMP, 20 mN $H_2SO_4$, batch times of 60 min or 120 min. As shown in FIG. 7*a* (full spectra, 4000-500 $cm^{-1}$), absorbances at 3300 $cm^{-1}$ (O—H peak) and 2900 $cm^{-1}$ (C—H stretching) of carbohydrates had increased intensities in the lignin samples in comparison to the feed (pine) due to deconstructed dissolved carbohydrates co-precipitating with the extracted lignins. As batch time increased from 60 to 120 min, intensities relating to carbohydrates increased, corresponding to higher degrees of carbohydrate deconstruction. In the fingerprint region (1800-600 $cm^{-1}$, FIG. 7*b*), there were noticeable increased peak intensities at 1730 $cm^{-1}$ (C═O carbonyls in ester groups and acetyl groups in xylan) for the DMP lignins, which could be attributed to the concurrent dissolution of hemicellulose and its precipitation during the workup stage. The band at 1635 $cm^{-1}$ (absorbed O—H and conjugated C—O in polysaccharides) was highest for 120 min lignin, which suggests more incorporation of carbohydrates as the batch time increased. IR bands indicative of lignin moieties and guaiacyl units in the lignin precipitates at 1510 $cm^{-1}$ (C═C stretching of the aromatic ring), 1465 $cm^{-1}$ (C—H asymmetric bending in lignins methoxyl groups), 1425 $cm^{-1}$ (aromatic skeletal vibrations of lignin), 1265 $cm^{-1}$ (C—O vibration in guaiacyl rings), 1225 $cm^{-1}$ (OH vibration in guaiacyl ring, C—C, C—O, and C═O stretches in lignin), 860 $cm^{-1}$ (C—H out of plane in position 2, 5, and 6 of guaiacyl units), and 825 $cm^{-1}$ (C—H out of plane deformation in guaiacyl units) were all enhanced in the 60 min and 120 min lignin samples when compared to the pine feedstock.

The "greenness" of GDE organosolv processing of lodgepole pine was benchmarked against optimum conditions reported by previous studies using bio-based solvents with mass-based green chemistry metrics. Specifically, γ-valerolactone (GVL), glycerol, Cyrene and tetrahydrofurfuryl alcohol (THFA) were selected for benchmarking due to their similar characteristics as GDEs (e.g., biobased, elevated boiling points). Two mass-based green chemistry metrics were evaluated, including mass intensity (MI), which is the ratio between the total mass of input materials in a chemical process (e.g., solvents, acid additives, biomass, excluding water) and the mass of the product, as shown by Eq. 10:

$$\text{Mass Intensity } (MI) = \frac{\text{Total mass in process}}{\text{Mass of product}} \quad (10)$$

In the present study, we evaluated the mass of the products using either isolated lignins or residual pulp. Solvent intensity (SI) was also evaluated, which is being defined as the ratio of the mass of the organosolv solvents to the mass of the product,[56] as shown by Eq. 11:

$$\text{Solvent Intensity } (SI) = \frac{\text{Mass of solvent}}{\text{Mass of product}} \quad (11)$$

where the mass of solvents in this case accounts for the solvent-water mixture and the mass of product accounts for the mass of isolated lignin or residual pulp.[56]SI values were only considered for the organosolv treatment and do not include contributions by downstream separation and isolation steps.

Figure 8A:
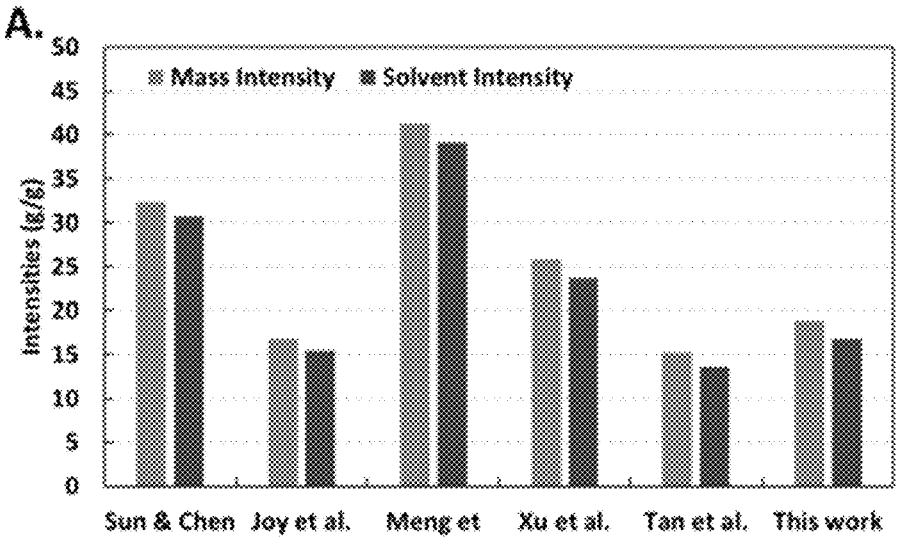
FIGS. 8A and 8B depict mass and solvent intensities on (FIG. 8A) pulp basis and (FIG. 8B) lignin basis of selected biobased high-boiling point organosolv processes compared to the present work. Conditions for the work studied are: 150° C., 60 min, 12 wt % biomass, 20 mN $H_2SO_4$.
Figure 8B:
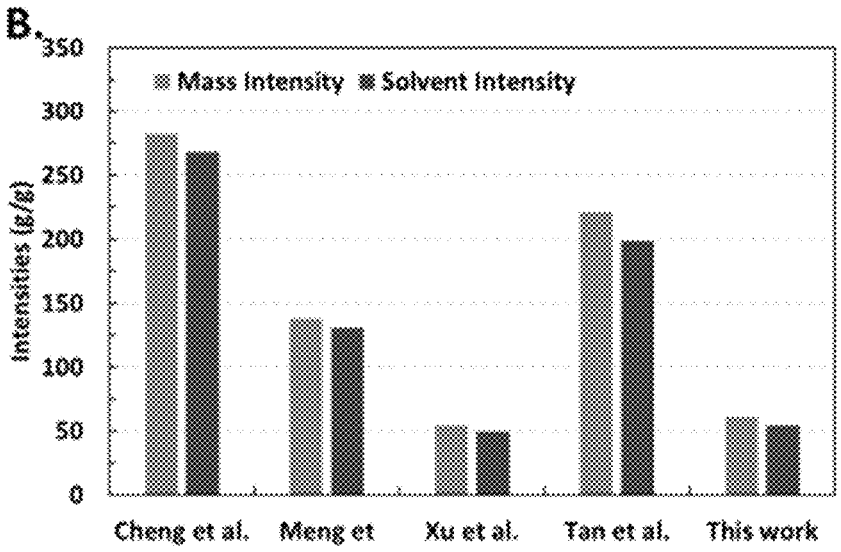

Calculated MI and SI values are offered in FIG. 8. We first will briefly summarize the benchmarked literature and then compare green chemistry metrics. Sun and Chen (*Bioresour Technol* 2008, 99 (13), 5474-5479) pretreated wheat straw with three different types of glycerol: industrial grade (IG, 95% purity, diluted to 70% w/w), crude glycerol from sebacic acid production (CGSAP, 40-50 wt % glycerol), and crude glycerol from biodiesel production (CGBP, 70 wt % glycerol) at 220° C. for 3 h with 5 wt % biomass loading. Based on their hydrolysis yield (~90% for IG pretreated pulp), IG was considered to be the optimum solvent, and the product in this case was the pulp. Joy and Krishnan (*Ind Crops Prod* 2022, 177, 114409) pretreated sorghum biomass with ammoniacal glycerol solution and their optimum condition was 120° C. for 60 min at 10% biomass loading where their maximum sugar yield was about 420 mg/g. Meng and colleagues (*Green Chemistry* 2020, 22 (9), 2862-2872) carried out a thermochemical pretreatment of Populus trichocarpa×deltoids with different cyrene/water mixtures at different reaction conditions. Their optimized conditions (80 vol % cyrene, 120° C., for 1 h and 6.6 wt % biomass loading) were considered in the calculations and their products were both isolated lignin and dried pulp. Xu et al. (*Fuel* 2023, 338, 127361), pretreated masson pine with 80 vol % of different solvents and found that their optimum system was based on both delignification and glucose yield, which consisted of GVL, 150° C., and 75 mM sulfuric acid for 1 h. In another study, Tan and coworkers (*Fuel* 2019, 249, 334-340) identified tetrahydrofurfuryl alcohol (THFA) as an effective solvent for pretreatment of hybrid Pennisetum (HP) under their optimized conditions (solid loading of 12%, 100° C. for 2 h and 50 mM sulfuric acid). Additionally, Cheng and coworkers (*Green Chemistry* 2023, 25 (1), 336-347) pretreated poplar in an aqueous GVL solution (85 mM sulfuric acid, 10 wt % solid loading) at different temperatures and batch times. Their optimum conditions were determined as 90° C. for 3 h (1.5 h×2). However, the authors would introduce fresh acidic GVL to extract further lignin. In the present study, the optimum conditions were the organosolv treatments that were conducted at 150° C. for 60 minutes and the solution consisted of 12 wt % biomass, 90 vol % GDE, and 20 mN $H_2SO_4$. Based on our estimates of the mass-based metrics (PI and SI), GDE organosolv compares favorably with other bio-based solvents and has some of the lowest mass and solvent intensities of all the work evaluated. The favorable MI and SI of the GDE organosolv system are due to high biomass loading (12 wt %), relatively high pulp yields (~50%), high delignification (>70%), and high lignin isolation yield, in comparison to the other benchmarked processes. MI and SI values are higher for lignin basis (FIG. 9*b*) than those based on pulps (FIG. 9*a*) as lignin constitutes generally less than 30 wt % of lignocellulosic biomass.

Example 4—Catalytic Hydrogenation of Softwood Lignin

Lodgepole pine (LPP) chips sized at ≤2 mm underwent a drying process in a vacuum oven at 105° C. for 15 h until a consistent mass was achieved. The moisture content of the chips was determined by dividing the mass of the dried chips by the mass of the chips before drying. Extractives were removed via Soxhlet extraction using EtOH and resulting extract-free biomass was subjected to washing, filtration, and drying to produce dried extract-free pine (DEFP).

$H_2$-free RCF experiments were carried out in 15 mL heavy-wall, borosilicate tube reactors (Ace Glass). 730 mg of biomass (DEFP) were carefully loaded into the reactors following by catalyst (either Ru/C 5 wt % Ru or Pt/C, 5 wt % Pt) (0.1-0.3 g cat/g DEFP), solvent (0.0068, 0.0096, 0.0137, 0.0205 mL/mg DEFP), and a magnetic stir bar. Reactors were sealed with a Teflon screw cap and placed into a preheated oil bath with a mixing rate of 1000 rpm. Variations in the process solvent composition, reaction temperature (160-250° C.), time (1-7 h), catalyst dosage and solvent-to-DEFP ratio were employed to achieve optimal results. Variations in process solvent composition included use of either neat 7 mL GDE, 7 mL GDE+acetic acid (AA) as an additive (0.5, 0.6, 0.7 g AA $g^{-1}$ DEFP), 1:1 vol GDE/vol $H_2O$, and finally 1:1 vol GDE/vol $H_2O$ with an AA additive loading of 0.6 g AA $g^{-1}$ DEFP. Control experiments including RCF in the absence of catalyst, and 1:1, 1:5 and 2:1 v/v glycerol/$H_2O$ solvents were also performed. After completing a set reaction time, the reaction was quenched by allowing the reactor to cool to room temperature. Vacuum filtration was used to separate the resulting black liquor (BL) from residual pulp, after which the pulp was washed with 10 mL isopropanol, 10 mL acetone and 5×10 mL ultrapure water before drying for 12 h at 105° C. in an oven. Concern of pulp yield overestimation due to the presence of catalyst particles in the isolated pulp was resolved using Energy-dispersive X-ray Spectroscopy (EDS). Result of EDS analysis revealed negligible presence of catalyst metal in the pulps. Liquid-liquid extraction (LLE) (to remove soluble sugars) and micro-distillation unit operations (to remove GDEs) were carried out on the BL to yield the desired depolymerized lignin oil (LO).

Figures 9A, 9B:
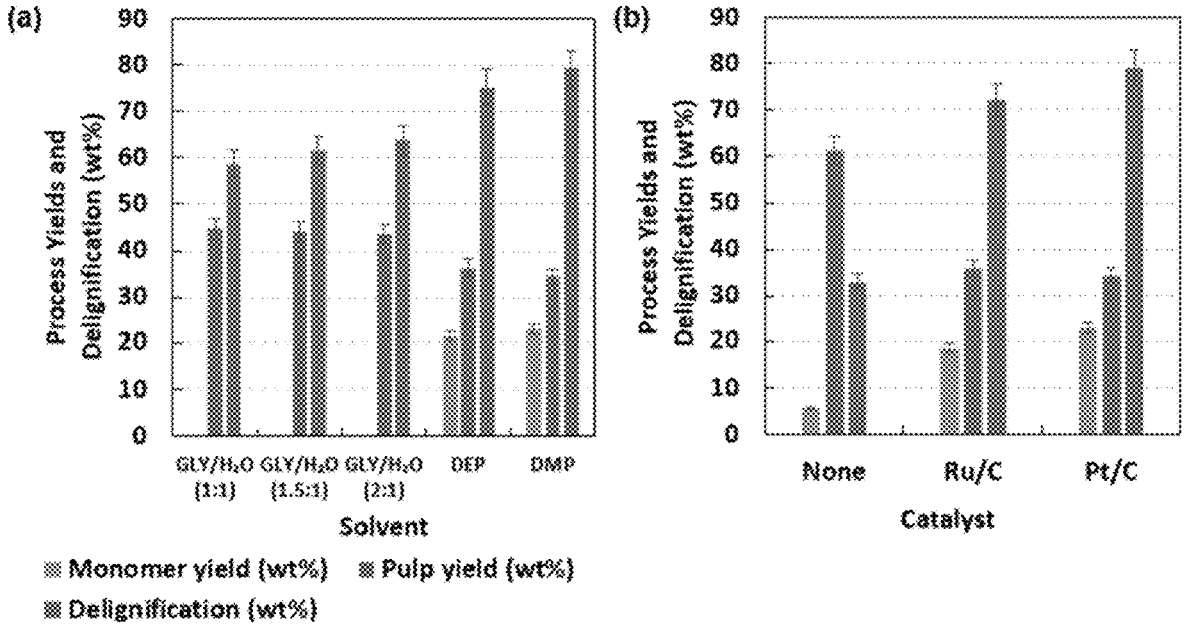
FIGS. 9A and 9B depict total monomer yield, pulp yield, and delignification with respect to speciation of (FIG. 9A) solvent (Pt/C as catalyst) and (FIG. 9B) catalyst (DMP as solvent). Reaction conditions: 730 mg DEFP, 7 mL solvent, 73 mg catalyst, 200° C., 7 h, 0.1 g/g catalyst dosage, 0.0096 mL/mg solvent-to-DEFP ratio, 1000 RPM.

FIG. 9A offers results for monomer yield, delignification, and pulp yield resulting from $H_2$-free RCF using DMP, DEP, and aqueous glycerol solvents. Glycerol was evaluated as a benchmark for GDEs, and aqueous glycerol solutions were evaluated due to difficulty in working up viscous glycerol liquors. RCF was conducted at 200° C. for 7 hr and 10 wt % catalyst (5 wt % Pt/C) loading. For clarification, monomer yields and delignification are based on the initial lignin content of DEFP (0.289 g lig. $g^{-1}$ DEFP), while pulp yields are based on the total DEFP mass. Dried pulp yields were found to be highest when using aqueous glycerol mixtures, ranging from 43.6-44.8 wt %. GDEs produced lower pulps as DMP and DEP resulted in yields of 34.4 wt % and 36.3 wt %, respectively. Correspondingly, DMP and DEP facilitated higher degrees of delignification, 79.1 wt % and 75.2 wt %, respectively, while values for aqueous glycerol mixtures ranged from 58.7-63.7 wt %. RCF using DMP produced the highest monomer yield, 22.9 wt %, while DEP yielded 21.4 wt %. Aromatic monomer yields were not reported for the aqueous glycerol mixtures as their viscosity inhibited successful work up of the product matrix to isolate liquid products derived from lodgepole pine. This observation buttresses earlier motivations for evaluating glycerol derivatives as RCF solvents.[28,64-66] The observed yields of aromatic monomers are comparable with those reported for conventional and hydrogen-transfer RCF, which demonstrates the efficacy of DMP and DEP as solvents for $H_2$-free RCF.

FIG. 9B provides the influence of heterogeneous catalyst on monomer yield, delignification, and pulp yield. Specifically, RCF was conducted at 200° C., 7 h, 0 wt % or 10 wt % catalyst loading, and DMP as solvent. With respect to aromatic monomer yield and delignification, in decreasing order, catalytic systems ranked as Pt/C>Ru/C>no catalyst. When pulp yield is considered, the opposite ranking occurs. Pt/C facilitated monomer yield and delignification of 22.9 wt % and 79.1 wt %, respectively, while Ru/C facilitated respective values of 18.6 wt % and 72.1 wt %. In the absence of catalyst, lower monomer yield and delignification, 5.5 wt % and 33.0 wt %, respectively, were observed. Interestingly, formation of monomers in experiments devoid of catalysts indicates GDEs can facilitate solvolysis of interunit linkages present in lignin. Further, higher degrees of delignification were observed for heterogeneous catalytic systems, which potentially indicates that deconstructed lignins support solubilization of lignins within lignocellulosic substrates.

As indicated by FIG. 9A, DMP performed as the optimal solvent as it is associated with higher monomer yields and delignification. Efficacy of DMP could be attributed to factors including favorable solubility of lignins and electronic effects facilitated by the terminal methoxy groups that promote hydrogen abstraction. Further, methoxy groups are smaller than ethoxy and experience less steric hindrance, thus, enabling increased molecular accessibility to extract lignins from mesoporous wood structures.

Figures 10A, 10B:
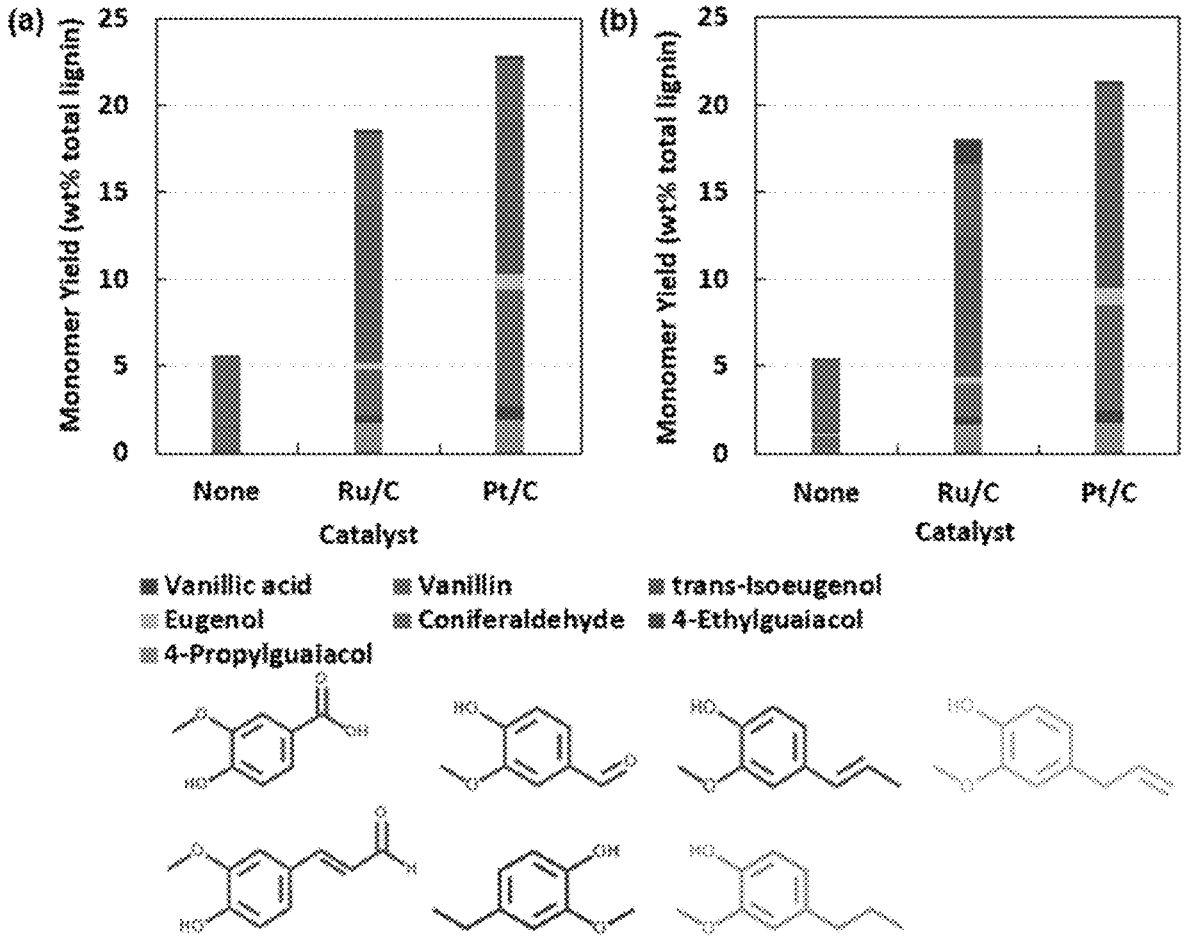
FIGS. 10A and 10B depict monomer yields (lignin mass basis) resulting from $H_2$-free RCF of DEFP with (FIG. 10A) DMP and (FIG. 10B) DEP. Reaction conditions: 730 mg DEFP, 7 mL solvent, 200° C., 7 h, 0.1 g cat. $g^{-1}$ DEFP, 0.0096 mL solvent $mg^{-1}$ DEFP, 1000 RPM.

FIG. 10 provides speciation of aromatic monomers produced by neat solvolysis (i.e., no catalyst) and $H_2$-free RCF. Neat solvolysis of DEFP using GDEs produced vanillin and coniferaldehyde as major monomer products. In the presence of heterogeneous catalyst, yields of monomer species increased along with a diversification of the product profile. For instance, in the presence of catalyst, major monomer species included vanillin, vanillic acid, trans-isoeugenol, eugenol, coniferaldehyde, 4-ethylguaiacol, and 4-propylguaiacol. Interestingly, selectivity favored highly functionalized lignin monomers, consisting of carbonylated and unsaturated side chains, which is a unique outcome of the present RCF study. Previous RCF works leveraging ex situ $H_2$ predominately produce lignin monomers containing saturated alkyl side chains (e.g., propyl, ethyl). More recent works pursuing $H_2$-free RCF with non-volatile solvents have reported presence of lignin monomers with alkenyl side chains, although in low abundance; lignin aromatic compounds with carbonylated side chains were not reported. Further, several of the resultant monomers in the present studies have direct economic value as fragrances and flavorants, including, vanillin, eugenol, and coniferaldehyde, which could enable an insertion point into high-value marketspaces. Overall, these observations indicate unique capacities of GDEs as hydrogen transfer solvents for enabling product selectivities towards functionalized and value-added aromatics.

Figures 11A, 11B, 11C, 11D:
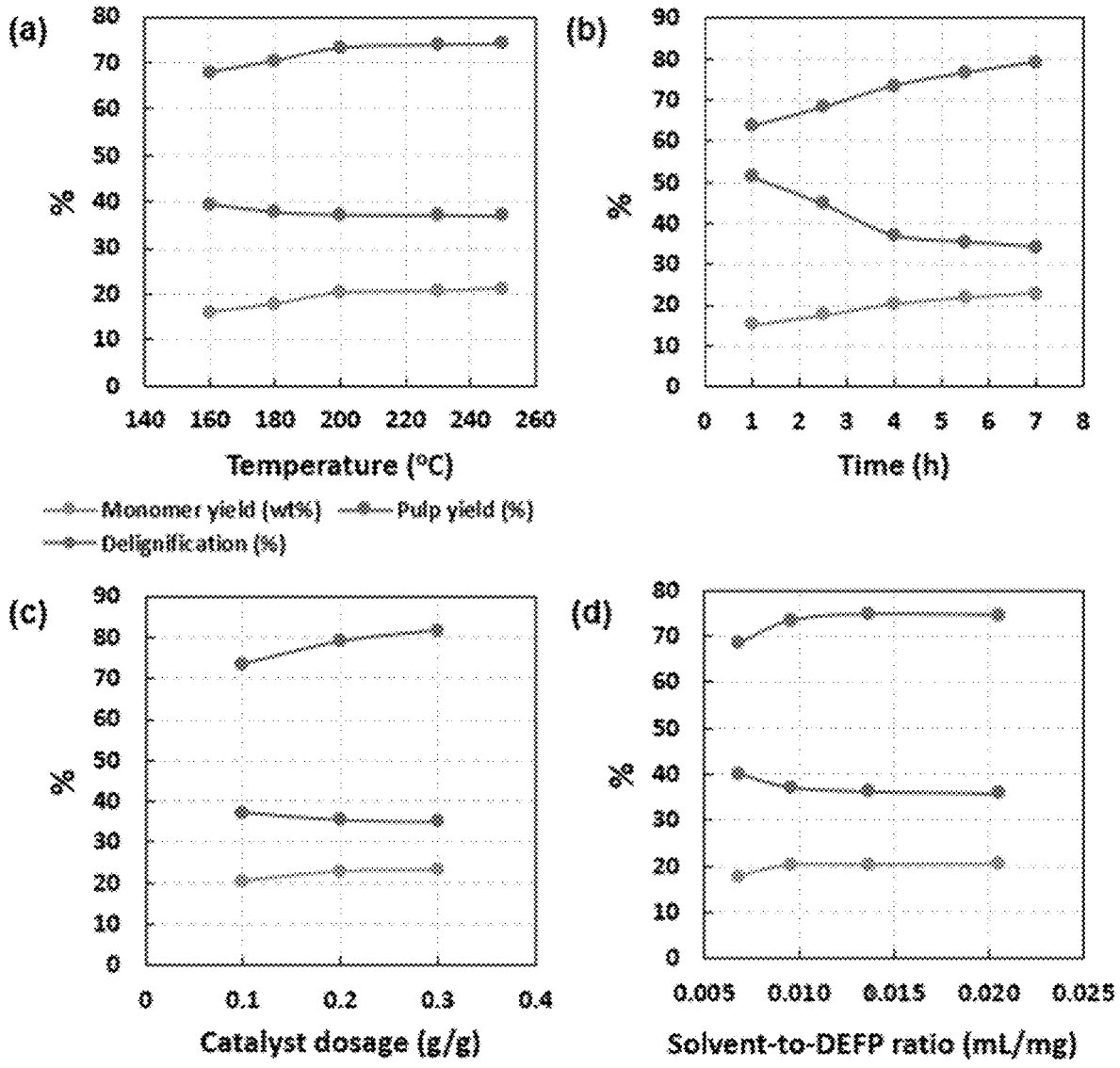
FIGS. 11A, 11B, 11C, and 11D depict the effects of (FIG. 11A) temperature, (FIG. 11B) time, (FIG. 11C) catalyst dosage, and (FIG. 11D) solvent-to-DEFP ratio on monomer yield (yellow), delignification (gray), and dried pulp yield (green). Reaction conditions: 730 mg DEFP, 7 mL DMP, 73 mg 5 wt % Pt/C, 200° C. (b, c, d), 4 hr (a, c, d), 0.1 g/g catalyst dosage (a, b, d), 0.0096 mL/mg solvent-to-DEFP ratio (a, b, c), 1000 RPM.

FIG. 11 presents the influence of RCF conditions on monomer yields, delignification, and dried pulp yields. Specifically, the influence of process conditions of temperature, time, catalyst dosage, and solvent-to-DEFP ratio was evaluated. Given their optimal performances observed previously, DMP and Pt/C were employed as solvent and catalyst, respectively FIG. 11A provides aromatic monomer yield, delignification, and pulp yield resulting from $H_2$-free RCF conducted for 4 hr and 10 wt % catalyst at varying temperatures. Monomer yield increased from 16.1 wt % to 20.3 wt % as temperature was varied from 160° C. to 200° C. Temperatures above 200° C. promoted small changes in monomer yield, for example, aromatic monomer yields at 230° C. and 250° C. were 20.7 wt % and 21.2 wt %, respectively. Delignification rose from 67.9 wt % to 73.4 wt % as temperature was increased from 160° C. to 200° C. Delignification followed a similar trend as the aromatic monomer yields, whereby increasing temperature beyond 200° C. had little impact; for instance, $H_2$-free RCF conducted at 250° C. led to a delignification of 74.3 wt %. Pulp yield reduced from 39.5 wt % to 37.2 wt % as temperature was increased from 160° C. to 200° C., followed by negligible drops to 37.1 wt % and 37.0 wt % with further increase of temperature to 230° C. and 250° C., respectively. Collectively, these observations indicate 200° C. is an optimal temperature for DMP-mediated, $H_2$-free RCF of softwood biomass. These trends are consistent with previous RCF, where significant increments in the yields of desired products were primarily observed at temperatures below 230° C. Beyond this temperature, increased increments had negligible effects on product yields.

FIG. 11*b* demonstrates the influence of batch holding time on aromatic monomer yield, delignification, and pulp yield resulting from RCF. These experiments were conducted at 200° C. with 10 wt % catalyst and varying batch holding times. Increasing the reaction time from 1 h to 7 h led to increasing monomer yield (15.3 to 22.9 wt %) and delignification (63.7 to 79.1 wt %) and decreasing pulp yield (51.3 to 34.4 wt %). These trends are consistent with previous reports as increasing process intensity led to higher product yields and deconstruction of biomass.

FIG. 11*c* offers insight into the influence of catalyst dosage on $H_2$-free RCF. RCF was conducted at 200° C. for 4 h, with varying catalyst dosages. An increase in catalyst dosage from 0.1 to 0.3 g cat. $g^{-1}$ DEFP resulted in an increase in the monomer yield (20.3 to 23.3 wt %) and delignification (73.4 to 81.7 wt %). However, monomer yield and delignification achieved with 0.2 g cat. $g^{-1}$ DEFP were similar to those resulting from 0.3 g cat. $g^{-1}$ DEFP. This trend indicates that further increase of catalyst dosage beyond 0.2 g cat. $g^{-1}$ DEFP has negligible impact on monomer yield and delignification. Similarly, for pulp yield, an increase in catalyst dosage from 0.1 to 0.3 g catalyst/g DEFP resulted in a decrease in value from 37.2 wt % to 35.0 wt %; pulp yields at 0.2 g cat. $g^{-1}$ DEFP and 0.3 g cat. $g^{-1}$ DEFP were comparable.

FIG. 11*d* provides the influence of solvent-to-DEFP ratio on $H_2$-free RCF. These experiments were conducted at 200° C. for 4 h and used 10 wt % catalyst. Experiments were conducted by fixing DEFP to a mass of 730 mg and varying the volume of DMP from 5 mL (0.0068 mL DMP $mg^{-1}$ DEFP) to 7 mL (0.0096 mL DMP $mg^{-1}$ DEFP). Overall, increasing solvent loading from 0.0068 to 0.0096 mL DMP $mg^{-1}$ DEFP led to an increase in monomer yield (17.8 to 20.3 wt %) and delignification (68.5 to 73.4 wt %). Enhancements in monomer yield and delignification by increasing solvent loading can be attributed to enhanced mass transfer, increased availability of hydrogen transfer sources, and better catalyst dispersion. Further increase in solvent loading did not facilitate appreciable improvements as 0.0205 mL DMP $mg^{-1}$ DEFP produced monomer yield and delignification of 20.5 wt % and 74.5 wt %, respectively. Similar trends were observed with the respect to decrease of pulp yield as solvent loading increased.

Figure 12:
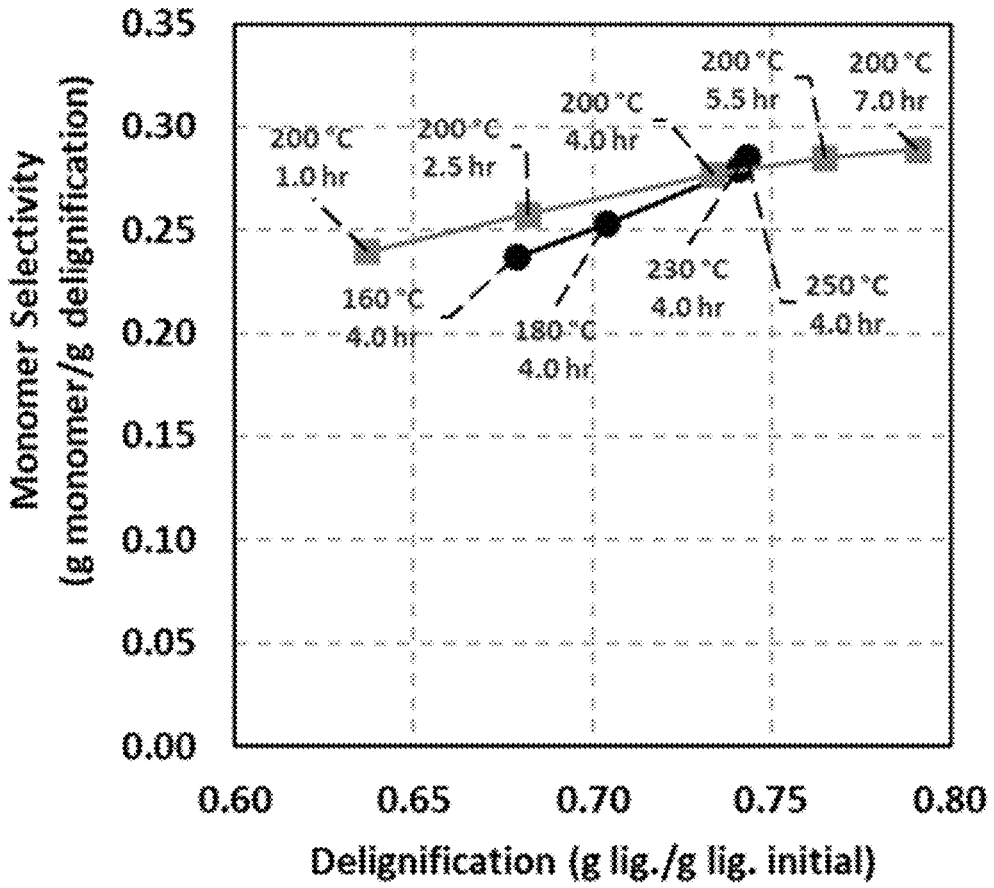
FIG. 12 depicts lignin extraction and monomer production relationship for temporal (blue, 200° C.) and temperature variations (black, 4 h). Reaction conditions: 730 mg DEFP, 7 mL DMP, 73 mg Pt/C, 0.1 g/g catalyst dosage, 0.0096 mL/mg solvent-to-DEFP ratio, 1000 RPM.

Relationships between the extent of delignification and monomer selectivity were evaluated in analogous fashion as classic conversion versus selectivity plots, as shown in FIG. 12. In this analysis, monomer selectivity is defined as the ratio of mass of lignin monomers and the mass of lignin removed from the softwood feedstock (i.e., yield divided by conversion). Two experimental cases were considered: isothermal condition (200° C.) with temporal variations, and constant batch holding time (4 h) with temperature variations. In both cases, as delignification increases from approximately 0.63 to 0.78 g $g^{-1}$ lig. initial, selectivity for monomers increases from approximately 0.24 to 0.29 g. mon. $g^{-1}$ delig. Monotonic increase of a given product selectivity in conversion versus selectivity plots indicates that the product is terminal with respect to the global reaction network. Under this interpretation, FIG. 12 suggests that aromatic monomers are terminal products within the evaluated reaction system. This observation is operationally significant as lignin-derived aromatics are known to be reactive towards recondensing into higher molecular weight products, especially in the presence of Bronsted acids or electron-deficient intermediates (e.g., carbocations). Thus, the delignification versus monomer selectivity plot indicates that GDE solvent systems support stabilization of aromatic monomers and may limit their selectivity towards formation of higher molecular weight products.

Figures 13A, 13B:
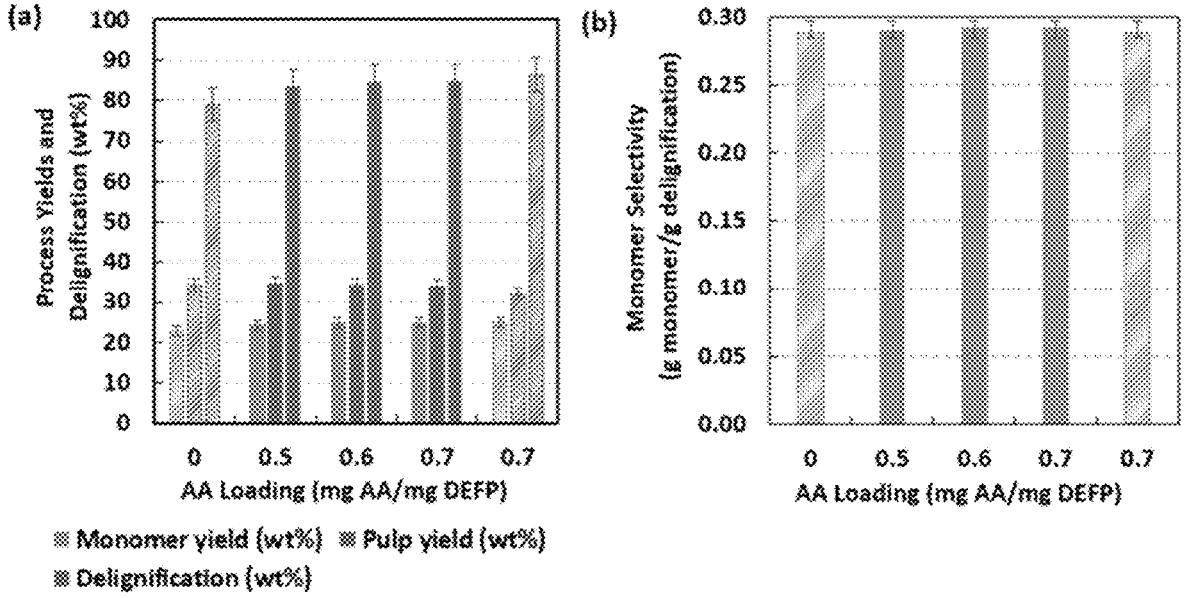
FIGS. 13A and 13B depict (13A) Influence of organic acid additive (AA) on $H_2$-free RCF process yields. 13B) Monomer selectivity of $H_2$-free RCF experiments with AA additive. Reaction conditions: 730 mg DEFP, 7 mL DMP, 73 mg Pt/C, 200° C., 4 h (bars not hatched), 7 hr (hatched bars), 0.1 g/g catalyst dosage, 0.0096 mL/mg solvent-to-DEFP ratio, 1000 RPM.

FIG. 13A demonstrates the effect of introducing organic acid additives (e.g., AA) to $H_2$-free RCF. Integrating AA was of interest as organic acids have precedent for increasing lignin extraction in organosolv processes. This study was conducted at 200° C. for 4 and 7 h, using a heterogeneous catalyst dosage of 10 wt %. Increasing the presence of AA led to higher monomer yields and delignification, thus indicating that organic acid additives promote lignin extraction and deconstruction. This observation is consistent with Renders et al.; however, these authors applied a stronger acid (e.g., $H_3PO_4$) which led to larger relative increases in yields. For a 4 h reaction, monomer yield increased from 22.9 wt % (no AA, 7 h) to 24.3 wt % (0.5 mg AA $mg^{-1}$ DEFP). Further increase to 0.6 and 0.7 mg AA $mg^{-1}$ DEFP led to limited increments in monomer yields, 24.7 wt % and 24.8 wt %, respectively. Extending the 0.7 mg AA $mg^{-1}$ DEFP loading experiment to 7 h led to a negligible monomer yield increase (24.9 wt %).

In the 4 h experiments, delignification showed an increase from 79.1 wt % (without AA) to 83.5 wt % (0.5 mg AA $mg^{-1}$ DEFP). Subsequent increases to 0.6 and 0.7 mg AA $mg^{-1}$ DEFP resulted in smaller increments in delignification, with values of 84.7 wt % and 84.9 wt %, respectively. Extending the duration of the experiment with a loading of 0.7 mg AA $mg^{-1}$ DEFP to 7 h, while keeping all other parameters constant, resulted in a reasonable increase in delignification to 86.4 wt %. Adding AA had negligible effect on pulp yield as the value decreased from 34.4 wt % (no AA) to 34.1 wt % (0.7 mg AA $mg^{-1}$ DEFP) after 4 hr. However, increasing the reaction time to 7 h promoted a small decrease pulp yield to 32.0 wt %.

FIG. 13B shows the monomer selectivity of the RCF under the same conditions provided in FIG. 13A. While addition of AA facilitated an increase in monomer yield, it had negligible effect on monomer selectivity as under all observed conditions, monomer selectivity was approximately 0.29 g mon. $g^{-1}$ delig. Collectively, these observations indicate that AA facilitates extraction of lignin from the wood matrix and does not inhibit production of monomers. Considering the trends in monomer yield, delignification, pulp yield, 0.6 mg AA/mg DEFP loading is a rational optimum loading.

Figure 14:
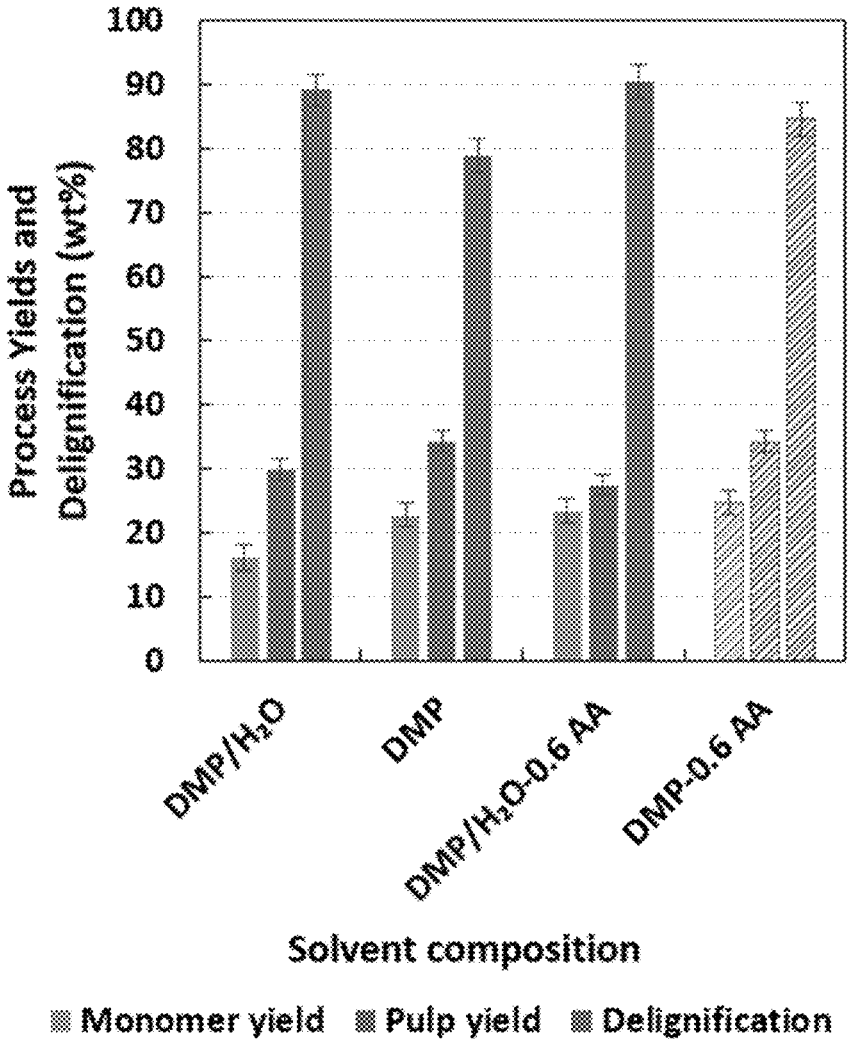
FIG. 14 depicts the influence of using water as a co-solvent on $H_2$-free RCF process yields. Reaction conditions: 730 mg DEFP, 7 mL DMP, 73 mg Pt/C, 200° C., 4 h (hatched bars), 7 h (bars not hatched), 0.1 g/g catalyst dosage, 0.0096 mL/mg solvent-to-DEFP ratio, 1000 RPM.

FIG. 14 provides the effects of water as a co-solvent on monomer yield, pulp yield, and delignification. Water as a co-solvent was evaluated as its nucleophilicity could facilitate solvolytic deconstruction of lignins and its low cost and abundance could potentially enhance process viability. Solvent mixtures consisted of equi-volume portions of DMP, and water and experiments were conducted at 200° C. using a catalyst dosage of 10 wt % and reaction times of 4 hr and 7 hr. Overall, addition of water as a co-solvent noticeably improved delignification, but suppressed aromatic monomer yield. For instance, RCF consisting of DMP/$H_2O$ (1:1 v/v) observed delignification and monomer yield of 89.2 wt % and 16.2 wt %, respectively; pure DMP treatments resulted with delignification and monomer yield of 79.1 wt % and 22.9 wt %, respectively. Aqueous DMP mixtures were also prepared with AA additive (0.6 mg AA $mg^{-1}$ DEFP), and interestingly, monomer yield and delignification of 23.5 wt % and 90.7 wt %, respectively, were observed. As such, aqueous co-solvent with the addition of organic acid additives can maintain monomer yields observed for neat solvent systems yet improve extraction of lignins from softwoods. Pulp yield as anticipated reduced with the increased delignification impact of using water as a co-solvent. With water as co-solvent, pulp yield was 30.0 wt %. The ability of water to enhance delignification albeit at the expense of monomer yield has been noted in some previous studies. Sels and colleagues evaluated solvent effects in RCF process, and observed that water facilitated the highest delignification, while apolar solvents were less effective. The authors reported ethylene glycol and MeOH facilitated high delignification, while tetrahydrofuran, and 1,4-dioxane (i.e., cyclic ethers) were less efficient for extracting lignins. Nonpolar solvents (e.g., n-hexane) were unable to appreciable extract lignin. Further, these studies suggest that increases in lignin extraction and suppression of aromatic monomers may be attributed to competitive adsorption of water to catalytic surface sites, as well as catalyst deactivation facilitated by water-induced leaching of transition metals.

MALDI-TOF mass spectra of select lignin oil (LO) samples produced via $H_2$-free RCF consisted of extracted and deconstructed lignins, including monomers and oligomers. Molecular weight ranges of chemical species were categorized as monomers (<250 m/z), dimers (275-450 m/z), trimers (450-600 m/z), tetramers (600-840 m/z), pentamers (850-1000 m/z), hexamers (1020-1180 m/z), and heptamers (1200-1350 m/z). LO samples associated with higher monomer yields had relatively lower molecular weight distribution. For instance, LO produced at 160° C., 4 h, with 10 wt % catalyst loading had a monomer yield of 16.1 wt % and molecular weight distribution ranging from 83 m/z to 1,300 m/z, while LO product at 200° C., 7 h, with 10 wt % catalyst loading had a monomer yield of 22.91 wt % and molecular weight distribution ranging from 83 m/z to 955 m/z. This trend is reasonable as it simply indicates further deconstruction of oligomeric fragments to monomers under process conditions that enhanced monomer yields. With regards to identification of specific molecular species, mass spectra of 181-182 m/z likely correspond to hydrogenated forms of coniferyl alcohol, guaiacyl acetone, or hydrogenated variant of hydroxy eugenol. Additionally, spectral peaks at 207-209 Da are attributed to dimethoxycinnamic acid and hydrogenated analogs. Within the molecular mass range of dimeric products, significant species may represent various structures such as biphenyl, phenylcoumaran, diarylpropane, and resinol types.

Additionally, MALDI-TOF MS facilitated insights on chemical modification of higher molecular weight species. For instance, MALDI TOF mass spectra indicate occurrence of dehydration reactions during $H_2$-free RCF as several major peaks differentiated by ~18 m/z (assuming z=1). For example, dehydration is indicated by the following pairs of mass spectra: 83.0 m/z-100.8 m/z, 100.8 m/z-118.8 m/z, 266.2 m/z-284.0 m/z, and 601.2 Da-619.2 m/z. In addition, decarbonylation reactions were evidenced differences of 28 m/z between the following mass spectra pairs: 434.1 m/z-462.1 m/z and 475.1 m/z-503.0 m/z.

$^1H$-$^{13}C$ HSQC NMR spectra of LO produced from $H_2$-free RCF conducted at 200° C. for 7 h, using DMP as solvent and 10 wt % catalyst dosage. Cross-peaks were assigned using previous reports in the literature. β-O-4 linkages, the most abundant native linkage, were absent. Further, all $^1H$-$^{13}C$ HSQC NMR spectra were absent of native β-5 phenylcoumaran units. Instead, spectra indicated presence of β-5 propanol (β-5 γ-OH) and β-5 ethyl (β-5 (E)) derivatives, which are obtained through hydrogenolysis of the etheric ring and hydrodeoxygenation, respectively. Similarly, native β-β resinol, β-1 spirodieneone, and 5-5 dibenzodioxicin structures were not present in the LO. Instead, hydrogenated forms of β-β THF, β-1 Propanol (β-1 γ-OH), and 5-5 biphenyl were observed.

Neat solvolysis experiments were conducted in the absence of catalyst to facilitate insights on the role of competing reaction processes (e.g., solvolysis, hydrogenolysis) on the deconstruction of lignins. Interestingly, a weak β-O-4 cross peak was observed in the 2D HSQC NMR spectrum of LO produced by neat solvolysis. Further, cross peaks indicative of other native structures, including β-5 phenylcoumaran and β-β resinol, were present in the $^1H$-$^{13}C$ HSQC NMR spectra. However, the signals corresponding to these native units were relatively weak compared to the signals of their hydrogenated forms, which were also present in the spectrum. Presence of β-O-4 linkages in solvolytic lignins indicate that hydrogenolysis pathways enabled by transition metal catalysts contribute to the lysing of etheric linkages. Further, the presence of native C—C linkages in the solvolytic lignins indicate that reductive pathways contribute towards their deconstruction and/or chemical modification.

Figure 15:
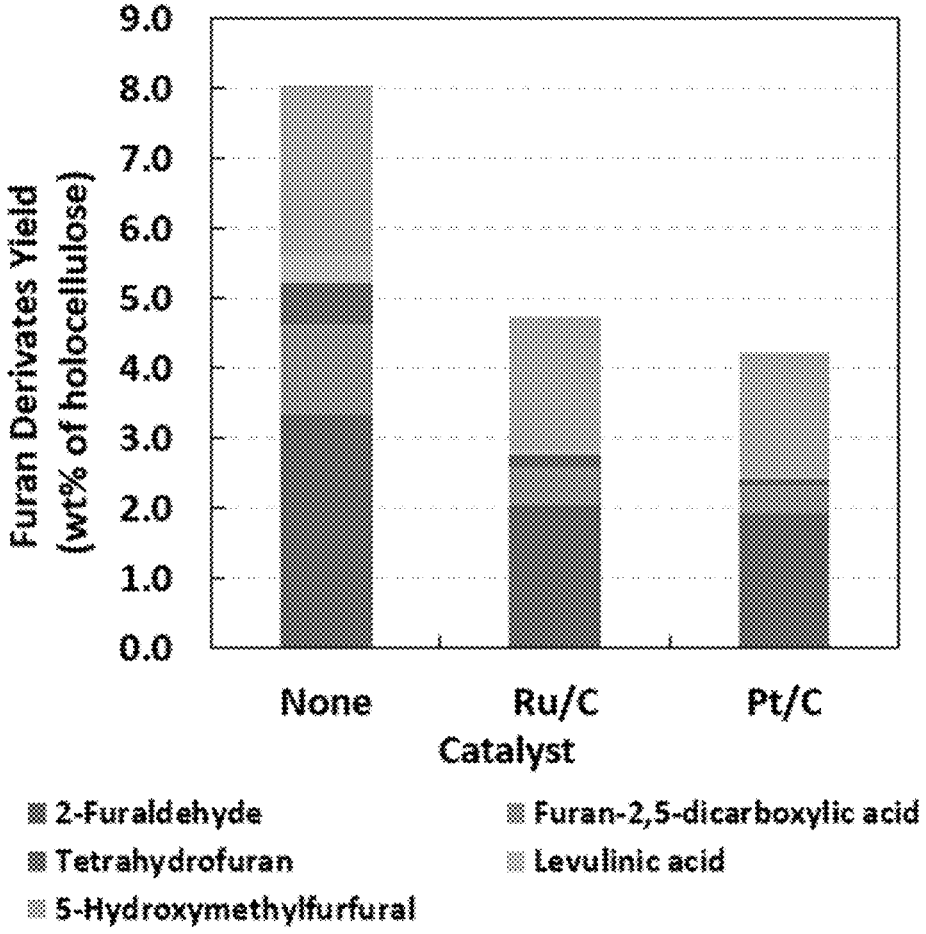
FIG. 15 depicts yields of furan derivatives from neat solvolysis and $H_2$-free RCF. Reaction conditions: 730 mg DEFP, 7 mL DMP, 73 mg catalyst, 200° C., 7 hr, 0.1 g/g catalyst dosage, 0.0096 mL/mg solvent-to-DEFP ratio, 1000 RPM.
Figure 16:
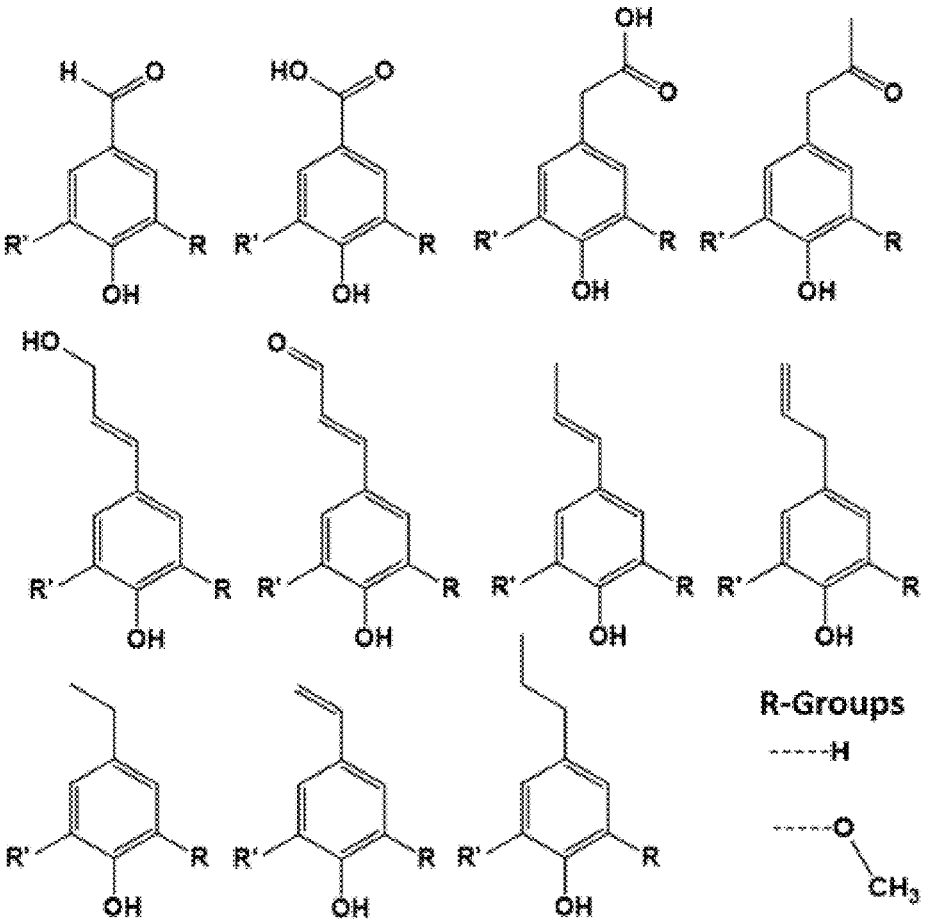
FIG. 16 depicts exemplary lignin compounds obtained by the disclosed processes.

In addition to aromatic monomers, other value-added small molecules, including furans derived from holocellulose, can be produced during solvolysis and hydrogenolysis of lignocellulosic biomass. FIG. 15 provides yields of furan derivatives resulting from neat solvolysis and $H_2$-free RCF of lodgepole pine conducted 200° C. and 7 h using DMP; the offered yields are normalized by the holocellulose content of lodgepole line. Previously, furans have been reported as minor products resulting from catalytic fractionation. Similar furan species were yielded from both neat solvolysis and RCF, including, 2-furaldehyde, 5-hydroxymethylfurfural (5-HMF), furan-2,5-dicarboxylic acid, and tetrahydrofuran. Levulinic acid was also produced, which is derived from ring opening of 5-HMF. Based on initial holocellulose content of 71.1% (519.0 mg of holocellulose in 730 mg DEFP), neat solvolysis, Ru/C catalyzed RCF, and Pt/C catalyzed RCF facilitated total furan yields of 8.1 wt %, 4.7 wt %, and 4.2 wt %, respectively. Interestingly, presence of supported transition metal catalysts induced lower yields of furans, which could be due to hydrogenation and hydrogenolysis of the observed furanic species. Neat solvolysis results in a higher yield of furan derivatives compared to monomers, while $H_2$-free RCF favors the opposite trend. While reduced forms of the observed furanic species were not directly detected in the present study, there is potential for GDEs to facilitate valorization of furans via transfer hydrogenolysis pathways in future works.

RCF studies focus primarily on depolymerization of lignins, however, residual cellulosic pulps constitute a major product fraction (~30 to 40 wt %) that will contribute to the economic viability of biorefining paradigms. XRD indicated DEFP and residual pulps displayed diffractogram patterns characteristic of cellulose $I_\beta$, specifically, peaks observed at 2θ of 16.3°, 22.5°, and 34.7°. Residual pulps had lower signal intensities than DEFP, indicating a reduction of their relative crystallinity. Reduced crystallinity of the resultant pulps can be due to chemical deconstruction of crystalline domains within the native cellulosic matrix; reduction in crystallinity of pulps with negligible change in diffractogram patterns has been previously reported. Overall, the shape, texture, and surface structure of lignocellulosic pulps are analogous to raw wood.

GDEs have been demonstrated as effective hydrogen transfer solvents for supporting lignin deconstruction into functionalized monomers under mild conditions. Monomer yields of ~20 wt % to ~25 wt % were achieved and delignification approaching ~90 wt % was achieved in the presence of aqueous and organic acid additives; these values are competitive with previous reports for softwoods. Monomer yields are improved in the presence of organic acid additives and are reduced when RCF is conducted aqueous co-solvent (without organic acid). Both AA additives and aqueous co-solvent facilitated enhanced delignification of lodgepole pine. Aromatic monomers consisted primarily of species with unsaturated and oxygenated sidechains, including, vanillin, trans-isoeugenol, coniferaldehyde, eugenol, and vanillic acid. Production of functionalized aromatics, especially those rich in oxygenated functionalities, contrast with prior RCF reports which primarily observe monomers with saturated alkyl sidechains (e.g., 4-propylguaiacol, 4-ethylguaiacol). This observation demonstrates that GDEs can support valorization of lignocellulosic biomass directly to value-added species suitable for fragrances and flavorants (e.g., vanillin, coniferaldehyde). Other small molecule product streams included furanic monomers derived from carbohydrate fractions, with higher yields observed for neat solvolysis than RCF, as the latter likely facilitated their reduction. MALDI-TOF MS of lignin oils indicated that the sidechains of higher molecular weight species undergo dehydration and decarbonylation reactions. $^{1}H$-$^{13}C$ HSQC NMR demonstrated presence of native linkages in lignin oils produced by neat solvolysis whereas samples resulting from $H_2$-free RCF were absent of native linkages, thus indicating the role of catalyst to facilitate hydrogenolysis. Residual pulps resulting from $H_2$-free RCF were produced at yields of ~30 to 40 wt % and maintained crystalline structures and overall morphology of the softwood feedstock. Collectively, these findings demonstrate the efficacy of GDEs for $H_2$-free RCF of softwood biomass into valuable aromatic and furanic monomers, which can be leveraged towards the development of sustainable and environmentally cogent lignin valorization processes. Future studies should consider roles of catalyst supports on transfer hydrogenolysis pathways and facilitating deconstruction of recalcitrant oligomers in order to improve production of value-added aromatic monomers.

ADDITIONAL ASPECTS

A method of processing biomass comprising heating a mixture comprising biomass and a solvent comprising a compound of Formula (1):

[Formula (1)]

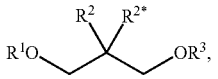

wherein $R^1$ is selected from $C_{1-8}$alkyl, $C_{3-8}$cycloalkyl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl;

$R^3$ is selected from H, $C_{1-8}$alkyl, $C_{3-8}$cycloalkyl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl;

$R^2$ and $R^{2*}$ together form an oxo, or $R^{2*}$ is H and $R^2$ is $OR^{2a}$ wherein $R^{2a}$ is selected from H, $C_{1-8}$alkyl, $C_{3-8}$cycloalkyl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl.

The method according to a preceding aspect, wherein $R^{2a}$ and $R^{2*}$ are H, and $R^1$ and $R^3$ are independently selected from methyl, ethyl, isopropyl, 2-methoxyethyl.

The method according to a preceding aspect, wherein $R^{2*}$ is H, and $R^1$, $R^{2a}$, and $R^3$ are independently selected from methyl, ethyl, isopropyl, 2-methoxyethyl.

The method according to a preceding aspect, wherein $R^2$ and $R^{2*}$ together form an oxo, and R1 and R3 are independently selected from methyl, ethyl, isopropyl, 2-methoxyethyl.

The method according to a preceding aspect, wherein the mixture further comprises water, $C_{1-4}$alcohol, or a combination thereof, for example methanol, ethanol, n-propanol, iso-propanol, n-butanol, iso-butanol, sec-butanol or tert-butanol, for example at a concentration from 1-50 wt. %, from 1-10 wt. %, from 5-15 wt. %, from 10-25 wt. %, from 15-30 wt. %, from 20-50 wt. %, or from 35-50 wt. %, relative to the compound of Formula (1).

The method according to a preceding aspect, wherein the heating comprises heating the mixture to a temperature from 75-250° C., from 75-150° C., from 75-125° C., from 100-250° C., from 100-200° C., from 100-150° C., from 125-175° C., or from 150-200° C.

The method according to a preceding aspect, wherein the mixture is agitated during heating.

The method according to a preceding aspect, wherein the mixture is agitated by stirring at 10-2,000 rpm, 10-1,000 rpm, 10-500 rpm, 10-250 rpm, 10-100 rpm, 10-50 rpm, 50-150 rpm, 100-250 rpm, 100-500 rpm, 250-750 rpm, 500-750 rpm, 500-1,000 rpm, 750-1,000 rpm, 1,000-2,000 rpm, 1,000-1,500 rpm, or 1,500-2,000.

The method according to a preceding aspect, wherein the mixture further comprises a homogeneous catalyst, a heterogeneous catalyst, or a combination thereof.

The method according to a preceding aspect, wherein the homogeneous catalyst comprises an acid, for example a protic acid like HCl, HBr, HI, $H_2SO_4$, $H_3PO_4$, $HNO_3$, acetic acid, toluenesulfonic acid, trifluoroacetic acid, fluoroacetic acid, propionic acid, a Lewis acid such as metal chloride like iron chloride, a metal triflate, for example iron triflate, gallium triflate, sodium triflate, scandium triflate, yttrium triflate, bismuth triflate, lanthanum triflate, or a combination thereof.

The method according to a preceding aspect, wherein the homogeneous catalyst is present at a concentration from 0.01-1.0 N, from 0.01-0.5 N, from 0.01-0.25 N, from 0.01-0.1 N, from 0.01-0.05 N, from 0.025-0.075 N, from 0.05-0.1 N, from 0.1-0.2 N, or from 0.15-0.2 N.

The method according to a preceding aspect, wherein the heterogeneous catalyst comprises a carbon-supported metal like Pd/C, Pt/C, Ru/C, Ni/C, Ni/alumina, Pd/alumina, Pt/alumina, Ru/alumina, Raney nickel, Raney cobalt, a metal sulfide like $Fe_2S$, a zeolite, or a combination thereof.

The method according to a preceding aspect, wherein the heterogeneous catalyst is present in an amount from 1-20 wt. %, from 1-15 wt. %, from 1-10 wt. %, from 1-5 wt. %, from 1-2.5 wt. %, from 2.5-5 wt. %, from 2.5-7.5 wt. %, from 5-10 wt. %, from 5-15 wt. %, from 10-20 wt. %, or from 15-20 wt. %, relative to the mass of the biomass.

The method according to a preceding aspect, further comprising separating the solvent from residual solids to provide a liquid comprising lignin compounds.

The method according to a preceding aspect, wherein the residual solids comprise cellulose in an amount of at least 90% by mass, at least 95% by mass, at least 97.5% by mass, at least 98% by mass, at least 99% by mass, or at least 99.5% by mass.

The method according to a preceding aspect, wherein separating the solvent from residual solids comprises filtering the mixture, optionally under reduced pressure.

The method according to a preceding aspect, further comprising separating the lignin compounds from the solvent.

The method according to a preceding aspect, wherein the lignin compounds are separated from the solvent by precipitation, for instance by reducing solvent volume, anti-solvent addition, cooling, addition of a seed, or combination thereof, or evaporating the solvent, optionally under reduced pressure and/or heat.

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than in the examples, or where otherwise noted, all numbers expressing quantities of ingredients, reaction conditions, and so forth used in the specification and claims are to be understood at the very least, and not as an attempt to limit the application of the doctrine of equivalents to the scope of the claims, to be construed in light of the number of significant digits and ordinary rounding approaches

What is claimed is:

1. A method of processing biomass comprising heating a mixture comprising biomass and a solvent comprising a compound of Formula (1):

[Formula (1)]

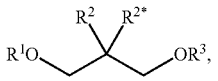

wherein $R^1$ is selected from $C_{1-8}$alkyl, $C_{3-8}$cycloalkyl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl;

$R^3$ is selected from H, $C_{1-8}$alkyl, $C_{3-8}$cycloalkyl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl;

$R^2$ and $R^{2*}$ together form an oxo, or $R^{2*}$ is H and $R^2$ is $OR^{2a}$ wherein $R^{2a}$ is selected from H, $C_{1-8}$alkyl, $C_{3-8}$cycloalkyl, aryl, or $C_{1-8}$heteroaryl optionally substituted one or more times by F, Cl, Br, $C_{1-8}$alkoxy, $C_{3-8}$cycloalkyl, aryl, $C_{1-8}$heterocyclyl, or $C_{1-8}$heteroaryl, wherein the mixture further comprises a homogeneous catalyst, a heterogeneous catalyst, or a combination thereof.

2. The method according to claim 1, wherein $R^{2a}$ and $R^{2*}$ are H, and $R^1$ and $R^3$ are independently selected from methyl, ethyl, isopropyl, 2-methoxyethyl.

3. The method according to claim 1, wherein $R^{2*}$ is H, and $R^1$, $R^{2a}$, and $R^3$ are independently selected from methyl, ethyl, isopropyl, 2-methoxyethyl.

4. The method according to claim 1, wherein $R^2$ and $R^{2*}$ together form an oxo, and $R^1$ and $R^3$ are independently selected from methyl, ethyl, isopropyl, 2-methoxyethyl.

5. The method according to claim 1, wherein the mixture further comprises water, $C_{1-4}$alcohol, or a combination thereof.

6. The method according to claim 1, wherein the heating comprises heating the mixture to a temperature from 75-250° C.

7. The method according to claim 1, wherein the homogeneous catalyst comprises an acid.

8. The method according to claim 7, wherein $R^{2a}$ and $R^{2*}$ are H, and the heterogeneous catalyst comprises Pd/C, Pt/C, Ru/C, Ni/C, Ni/alumina, Pd/alumina, Pt/alumina, Ru/alumina, Raney nickel, Raney cobalt, $Fe_2S$, a zeolite, or a combination thereof.

9. The method according to claim 8, wherein the heterogeneous catalyst is present in an amount from 1-10 wt. %, relative to the mass of the biomass.

10. The method according to claim 1, further comprising separating the solvent from residual solids to provide a liquid comprising lignin compounds.

11. The method according to claim 10, wherein the residual solids comprise cellulose in an amount of at least 90% by mass.

12. The method according to claim 10, wherein separating the solvent from residual solids comprises filtering the mixture.

13. The method according to claim 10, wherein the lignin compounds are separated from the solvent by precipitation.

14. The method according to claim 1, wherein the biomass comprises a vegetative species.

15. The method according to claim 14, wherein the biomass comprises a woody plant.

* * * * *